US007543411B2

(12) United States Patent
Whitehead et al.

(10) Patent No.: US 7,543,411 B2
(45) Date of Patent: Jun. 9, 2009

(54) LOW PROFILE PLASTIC PANEL ENCLOSURE

(75) Inventors: Steven Whitehead, Elgin, IL (US); Michael Uffner, Naperville, IL (US)

(73) Assignee: Suncast Corporation, Batavia, IL (US)

( * ) Notice: Subject to any disclaimer, the term of this patent is extended or adjusted under 35 U.S.C. 154(b) by 898 days.

(21) Appl. No.: 10/729,689

(22) Filed: Dec. 5, 2003

(65) Prior Publication Data

US 2005/0120641 A1 Jun. 9, 2005

(51) Int. Cl.

| | |
|---|---|
| ***E04B 1/346*** | (2006.01) |
| ***E04B 7/16*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/66; 52/67; 52/79.1; 52/79.3; 52/79.4

(58) Field of Classification Search ..... 52/66, 52/67, 79.1, 79.2, 79.3, 79.4
See application file for complete search history.

(56) References Cited

U.S. PATENT DOCUMENTS

| | | | | |
|---|---|---|---|---|
| 1,936,571 | A * | 11/1933 | Bumann | 446/123 |
| 3,866,381 | A | 2/1975 | Eschbach | |
| 4,557,091 | A | 12/1985 | Auer | |
| 4,570,392 | A * | 2/1986 | Oltman et al. | 52/64 |
| 4,986,037 | A * | 1/1991 | Jackson, Jr. | 52/67 |
| 5,036,634 | A | 8/1991 | Lessard | |
| 5,167,341 | A * | 12/1992 | Morton et al. | 220/349 |
| D371,208 | S | 6/1996 | De Zen | |
| 5,544,870 | A * | 8/1996 | Kelley et al. | 256/26 |
| 5,619,826 | A * | 4/1997 | Wu | 52/35 |
| 5,682,622 | A * | 11/1997 | Tagg | 4/449 |
| 5,706,613 | A * | 1/1998 | Drake et al. | 52/79.1 |
| 6,099,092 | A * | 8/2000 | Uffner et al. | 312/108 |
| 6,115,971 | A * | 9/2000 | Loebertmann et al. | 52/79.1 |
| 6,145,254 | A * | 11/2000 | Silva | 52/66 |
| 6,250,022 | B1 * | 6/2001 | Paz et al. | 52/79.5 |
| 6,418,672 | B1 * | 7/2002 | Hampel | 52/79.1 |
| 6,581,337 | B1 * | 6/2003 | Skov et al. | 52/79.5 |
| 6,604,328 | B1 * | 8/2003 | Paddock | 52/93.1 |
| 6,701,678 | B1 * | 3/2004 | Skov et al. | 52/79.9 |
| 6,796,087 | B1 * | 9/2004 | Greene | 52/32 |
| 6,892,497 | B2 * | 5/2005 | Moon et al. | 52/79.1 |
| 2003/0000154 | A1 * | 1/2003 | Ignazio | 52/66 |
| 2003/0014927 | A1 * | 1/2003 | Brooks | 52/66 |
| 2003/0140573 | A1 * | 7/2003 | Marcinkowski et al. | 52/79.5 |
| 2005/0120641 | A1 * | 6/2005 | Whitehead et al. | 52/79.1 |
| 2005/0223652 | A1 * | 10/2005 | Mower et al. | 52/79.1 |

* cited by examiner

*Primary Examiner*—Brian E. Glessner
*Assistant Examiner*—Branon C Painter
(74) *Attorney, Agent, or Firm*—McHale & Slavin, P.A.

(57) ABSTRACT

The present invention provides a system of injection molded panels having integrated connectors which combine to form a low profile enclosure having a telescoping roof. The panels are formed of injection molded plastic to interlock with one another without the need for separate I-beam connectors. The ends of the wall panels have cavities to accept both roof and floor outwardly projecting locking posts for interlocking cooperative engagement which serve to rigidly connect the components together. The construction of the wall, roof, floor and door components minimizes component shapes and simplifies enclosure construction.

27 Claims, 20 Drawing Sheets

LOW PROFILE PLASTIC PANEL ENCLOSURE

FIELD OF THE INVENTION

This invention relates generally to a low profile enclosure constructed of plastic structural panels. More specifically, the present invention relates to a low profile enclosure which includes telescoping roof panels.

BACKGROUND INFORMATION

Storage sheds are a necessity for lawn and garden care, as well as general all-around home storage space. Typically, garden tools and equipment are found either stacked into a corner of the garage, or bundled together and covered with a tarpaulin to protect them from the elements. During the off-seasons, lawn mowers, tillers and snow equipment often consume the available floor space of a garage, forcing the homeowner to park his/her automobile outside.

The prior art has proposed a number of different panel systems, or kits comprising blow molded or extruded panels and connector members for forming a wide variety of structures. Typically such systems are assembled into structures having a height sufficient to allow the owner to walk into the structure. Generally, such systems require extruded metal or plastic connector members having a specific cross-sectional geometry that facilitate an engagement between such members and one or more blow molded plastic panels having a complimentary edge configuration. Due to the nature of the manufacturing process, blow molded plastic components cannot be formed with the intricate shapes and/or sharp corners required for integrated connectors. In addition, blow molded plastic components are hollow and cannot be formed with the integral strengthening ribs and gussets possible with injection molding.

A particularly common structure for the connector members is the I-beam cross section. The I-beam defines free edge portions of the connector member which fit within appropriately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel and thereby serve to join such panels together at right angles. Straight or in-line versions of the connector members are also included in the kits to join panels in a co-planar relationship to create walls of varying length.

The aforementioned systems can also incorporate roof and floor panels to form a freestanding enclosed structure such as a utility shed. U.S. Pat. Nos. 3,866,381; 5,036,634; and 4,557,091 disclose various systems having interfitting panel and connector components.

Such prior art enclosure systems, while functional, nevertheless fail to meet longfelt needs of consumers to provide structural integrity combined with modularity and aesthetic appearance. The walk-in structures may be undesirable or unsightly where the roofs are visible over neighborhood fences or hedges. In some areas homeowner associations may not permit structures having an adequate height to allow the owner to walk into the enclosure due to the unsightly nature of the visible roof tops.

Paramount among such needs is a telescoping roof and pivoting door combination which allows items such as lawn tractors to be driven into the enclosure. Telescoping roof panels allow a low profile enclosure while still allowing an owner to walk into the enclosure for easy access to the contents. From a structural standpoint, the telescoping roof should be capable of easy installation after assembly of the wall and floor components, and be compatible with the walls. The wall and floor components should utilize a panel system which eliminates the need for panel connectors creating enclosure walls which resist panel separation, buckling, racking and weather infiltration.

There are also commercial considerations that must be satisfied by any viable low profile enclosure system or kit; considerations which are not entirely satisfied by state of the art products. The enclosure must be formed of relatively few component parts that are inexpensive to manufacture by conventional techniques. The enclosure must also be capable of being packaged and shipped in a knocked-down state. In addition, the system must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or operate. Moreover, the system must assemble together in such a way so as not to detract from the internal storage volume of the resulting enclosure, or otherwise negatively affect the utility of the structure.

BRIEF DESCRIPTIONS OF THE INVENTION

The present invention provides a system, or kit, of injection molded panels having integrated connectors which combine to form an enclosure, commonly in the form of a low profile utility enclosure. The enclosure is provided with a telescoping roof panel and pivoting doors which allow easy and dependable access to the interior of the enclosure. The system incorporates a minimum number of components to construct a low profile enclosure by integrally forming connectors into injection molded panels. The panels utilized to construct the low profile enclosure are formed of injection molded plastic and include sockets which accept both roof and floor locking posts for interlocking cooperative engagement which serves to rigidly connect the components together.

This minimizes the need for separate extruded or molded connectors to assemble the low profile enclosure. The symmetry of the wall, roof, floor and door components also minimizes component shapes and simplifies enclosure construction. Injection molding the wall panels allows them to be formed with adequate height to eliminate the need for stacking panels to achieve the desired height. Injection molding also allows the panels to be formed with integral cross-bracing, ribs and gussets for increased rigidity when compared to blow molded or extruded panels.

In one embodiment the enclosure system utilizes three types of wall panel construction for the side walls, expansion of the side walls, and the rear wall assembly. The embodiment also utilizes one construction of fixed roof panel, one construction of sliding roof panel, and one construction of floor panel. The system further includes a door assembly which utilizes two types of panels and slides into place after the walls and roof have been fully assembled. The floor of the system is constructed to allow optional wooden or plastic floor joists to be added to the plastic floor panels further increasing the structural integrity of the enclosure. The same components are used to create sheds of varying size and the assembly of the system requires minimal hardware and a minimum number of hand tools.

Accordingly, it is an objective of the present invention to provide a modular panel system having integrated connectors for creating low profile enclosures of varying dimension using common components.

A further objective is to provide a modular panel system for creating low profile enclosures wherein the panels include integrated connectors which accommodate injection molding plastic formation of the panel components for increased structural integrity.

Yet a further objective is to provide a low profile enclosure constructed from modular panels in which the side walls, roof, and floor are integrally interlocked without I-beam connectors.

Another objective is to provide a low profile enclosure constructed of modular panels having a roof assembly which allows a portion of the roof to be telescopically retracted and extended.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
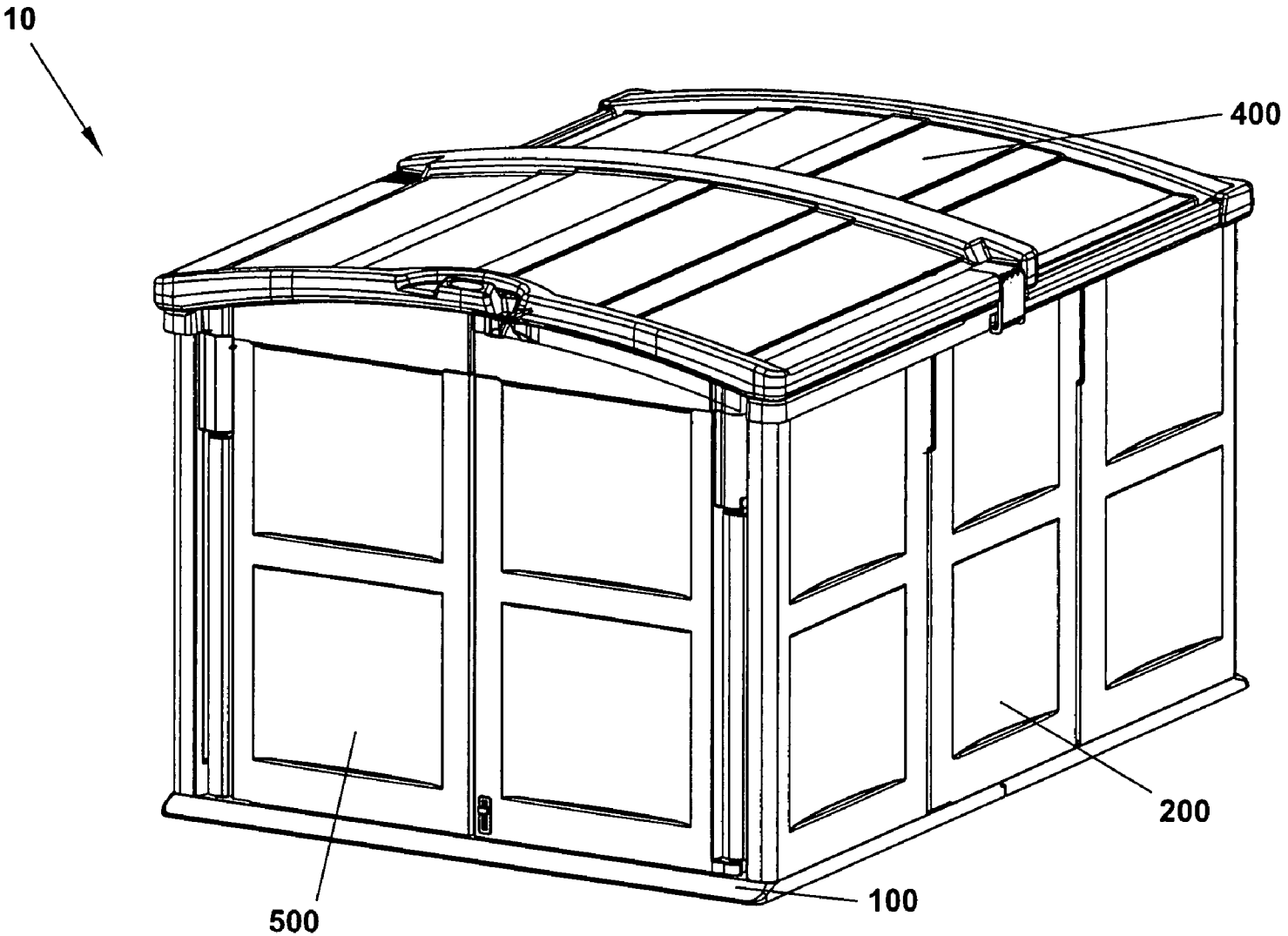
FIG. 1 is a perspective view of a low profile enclosure constructed using the instant enclosure system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
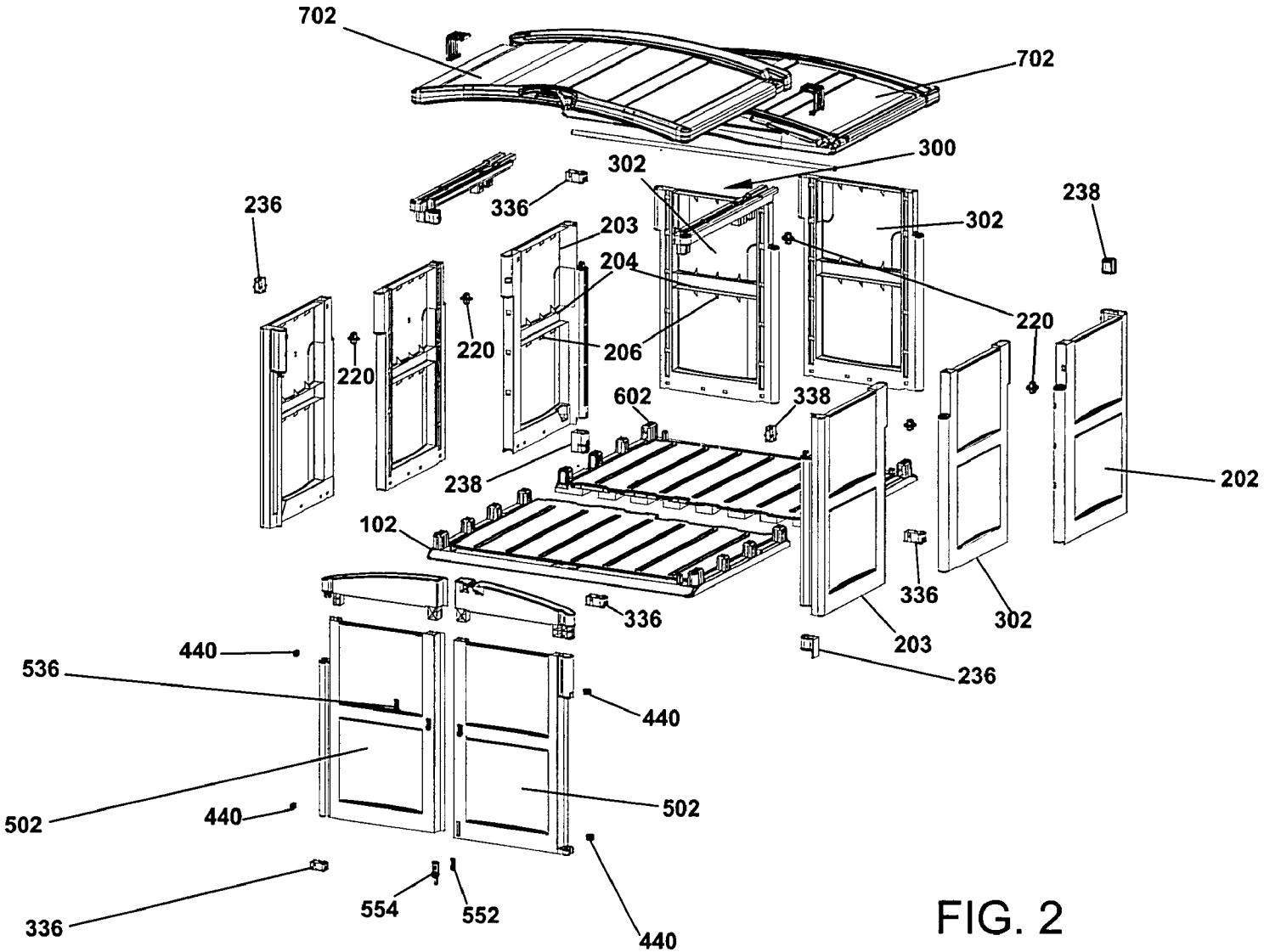
FIG. 2 is an exploded view of the enclosure shown in FIG. 1.

FIGS. 1 and 2 which are now referenced show an isometric and exploded view of the low profile enclosure, generally referenced as 10, according to a preferred embodiment of the present invention. The enclosure is made up of a floor assembly 100, left and right side wall assemblies 200, rear wall assembly 300 (FIG. 2), roof assembly 400 and door assembly 500. In the preferred embodiment, the panels comprising the assemblies are formed of, but not limited to, a suitable polymeric material through the process of injection molding. The result is that the panels comprising the floor 100, walls 200-300, roof 400, and doors 500 of the enclosure 10 are formed as unitary panels with integral connectors and cross bracing. Strengthening ribs 204 and gussets 206 (FIG. 2) are formed within the inner surfaces of the wall panels 202, 203, 302 and 502 in order to enhance rigidity of the panels while leaving the external surface in a generally smooth condition for aesthetic purposes, as shown in FIG. 1. The panels are utilized to construct the floor assembly 100, left and right wall assemblies 200, rear wall assembly 300, door assembly 500, and roof assembly 400 using a minimal number of components.

Figure 3:
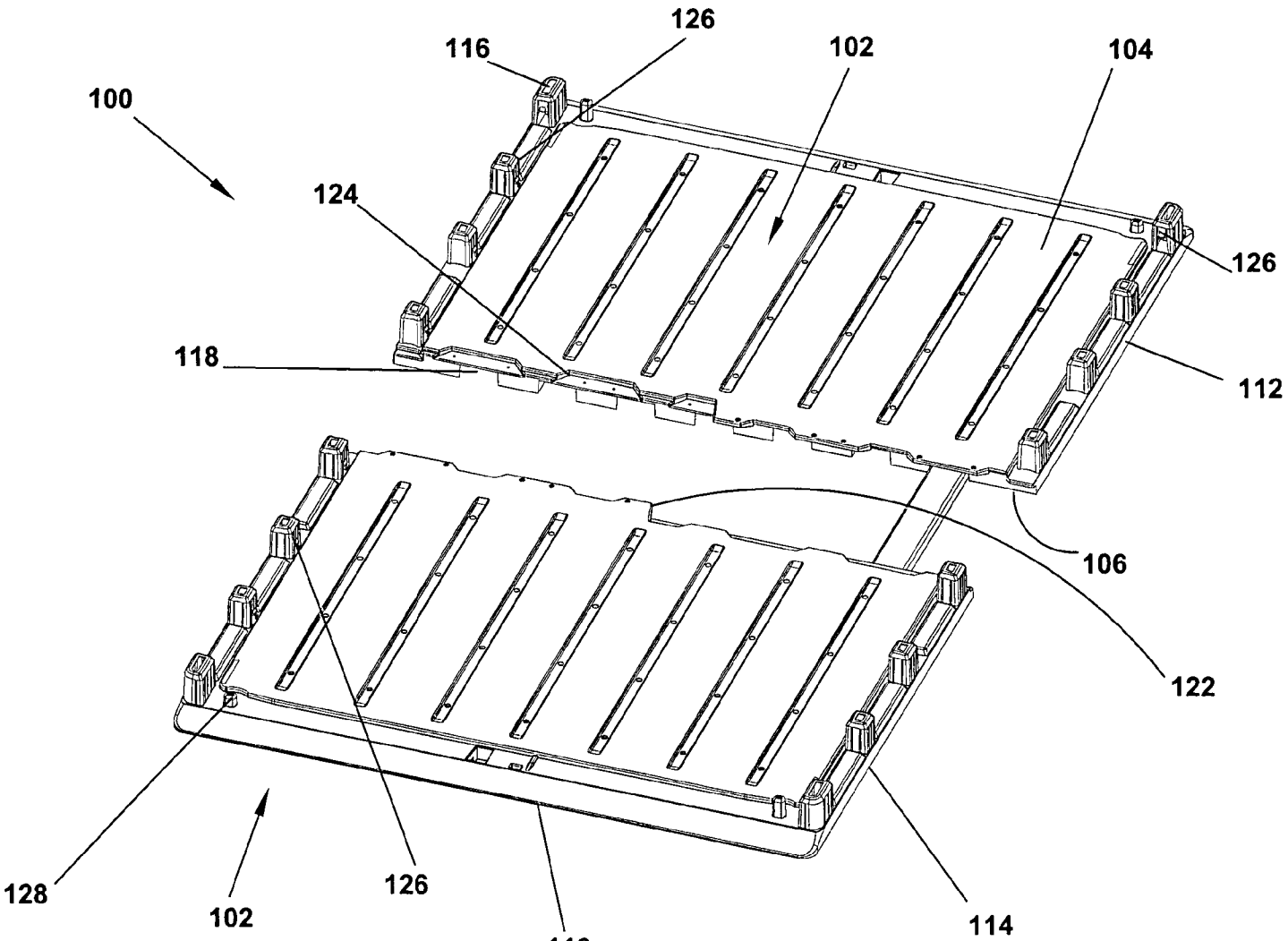
FIG. 3 is a perspective view of one embodiment of the floor assembly utilized in the instant invention.
Figure 4B:
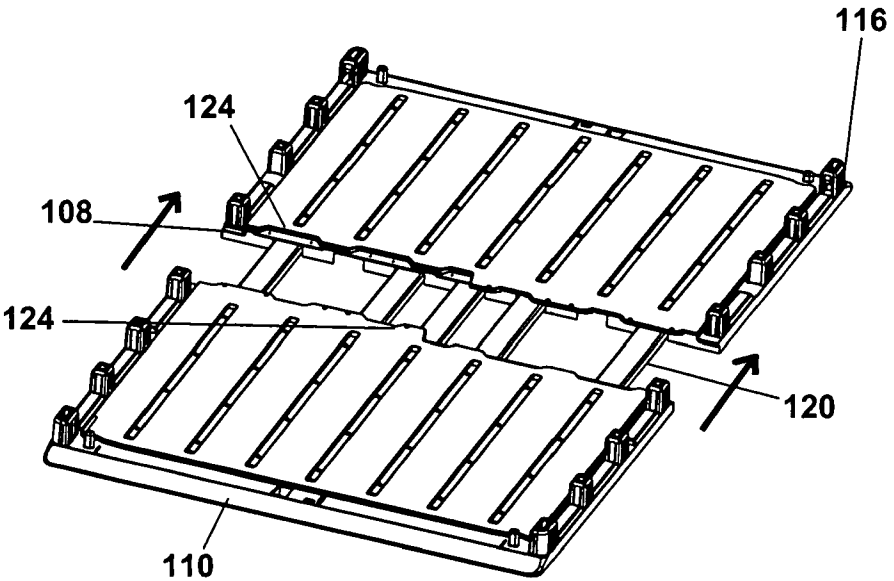
FIG. 4B is a perspective view of the floor assembly illustrating the sliding engagement of the floor panels.
Figure 4A:
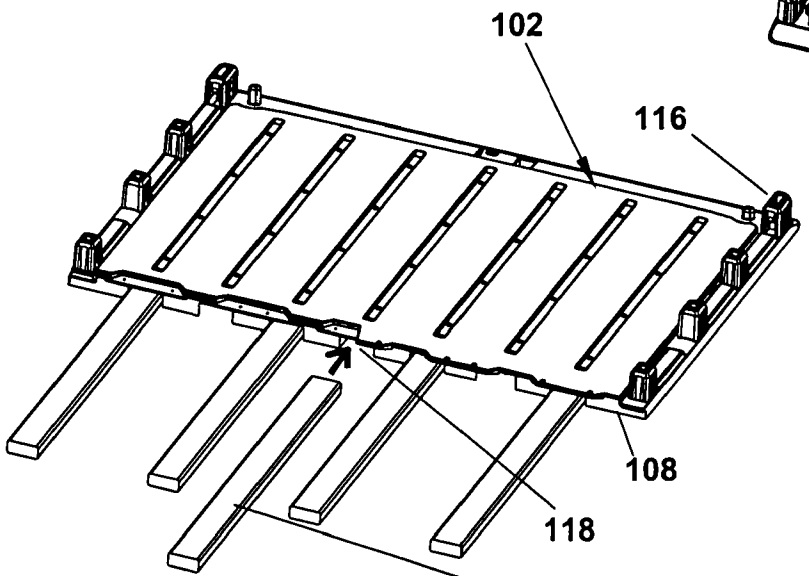
FIG. 4A is a perspective view of the floor assembly illustrating the optional wooden floor joists.
Figure 5:
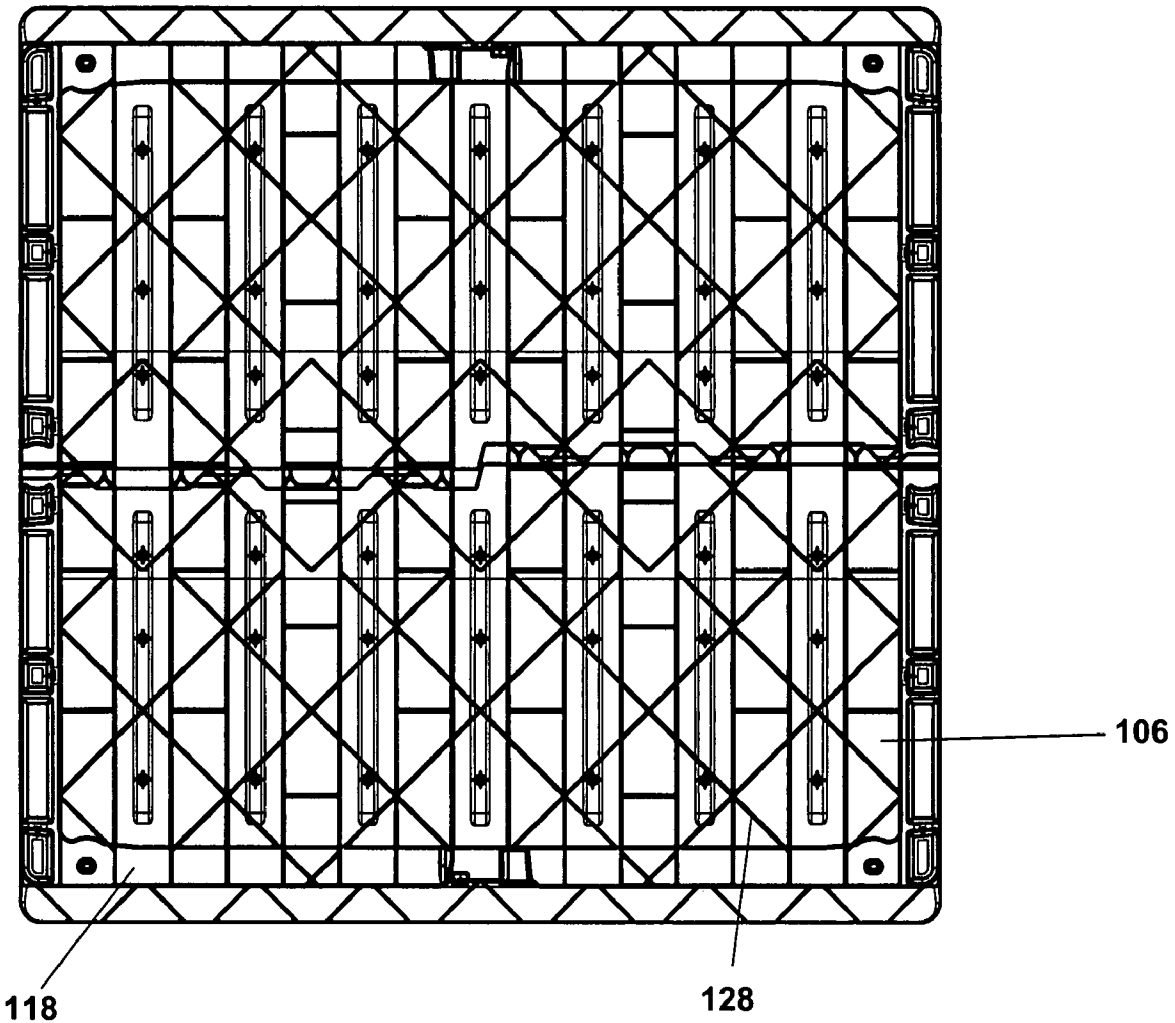
FIG. 5 is a bottom view of the floor assembly illustrating the cross-bracing.

Referring to FIGS. 3-5, the enclosure includes a pair of like-constructed floor panels 102. Each panel has a top surface 104, bottom surface 106, locking edge 108, ramp edge 110, and two closed edges 112 and 114. Adjacent to each of the closed edges is a means of attaching the floor assembly to the wall assemblies illustrated as a plurality of locking posts 116 extending upwardly from the top surface 104. The locking posts 116 are constructed and arranged to cooperate with sockets 210 (FIG. 7) located at each longitudinal end of the first, second, and third structural wall panels 202, 302 and 203 respectively. Adjacent to each of the ramp edges 110 is a pair of generally cylindrical hinge pins 128 extending upwardly. The hinge pins 128 cooperate with the door panels 502 to allow pivotal movement. A series of spaced apart tubes 118 extend through each floor panel 102 under the top surface 104 and between the locking edge 108 and the ramp edge 110. The tubes 118 are sized to accept optional wooden floor joists 120 (FIGS. 4A,4B) adding increased weight capacity and stability to the enclosure 10. Along the locking edge 108 of each bottom panel 102 is a series of spaced apart fingers 122 and recesses 124 for attaching the panels together into a floor assembly 100; each of the fingers being provided with at least one countersank aperture for receiving a fastener (not shown). The fingers 122 and recesses 124 are constructed and arranged so that the fingers 122 overlap and mateably engage the recesses 124 and the fasteners secure the panels together in an inter-fitting engagement with their respective top surfaces 104 in a co-planar arrangement. The bottom surface 106 (FIG. 5) illustrates the cross-bracing 128 facilitated by injection molding of panels. Injection molding offers significant strength and stability advantages over blow-molding as utilized in the prior art. In this manner the enclosure of the instant invention is capable of handling a significant amount of weight as compared to blow molded enclosures.

Figure 6:
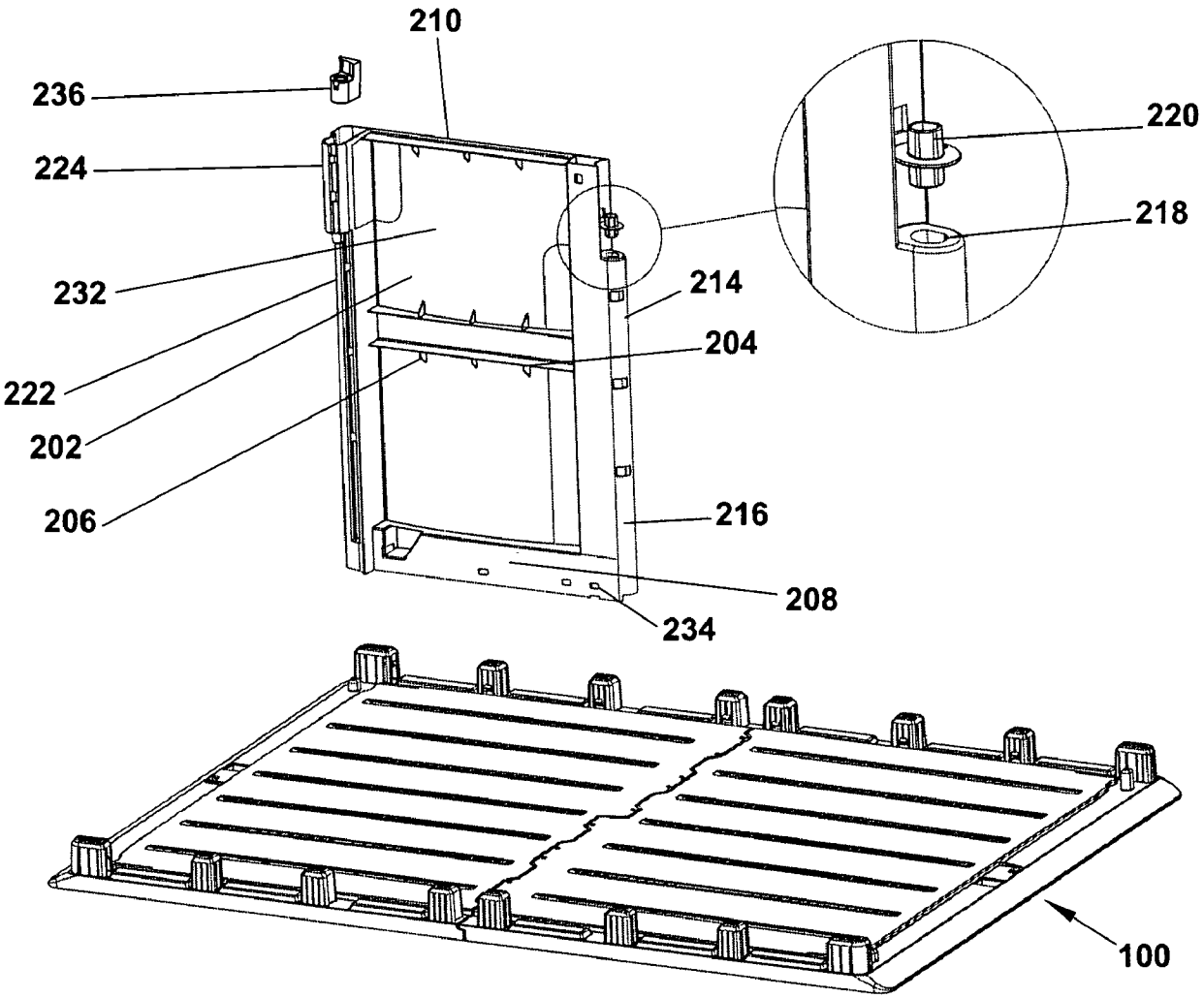
FIG. 6 is a partial perspective view illustrating assembly of the first left side wall panel to the floor assembly.
Figure 7:
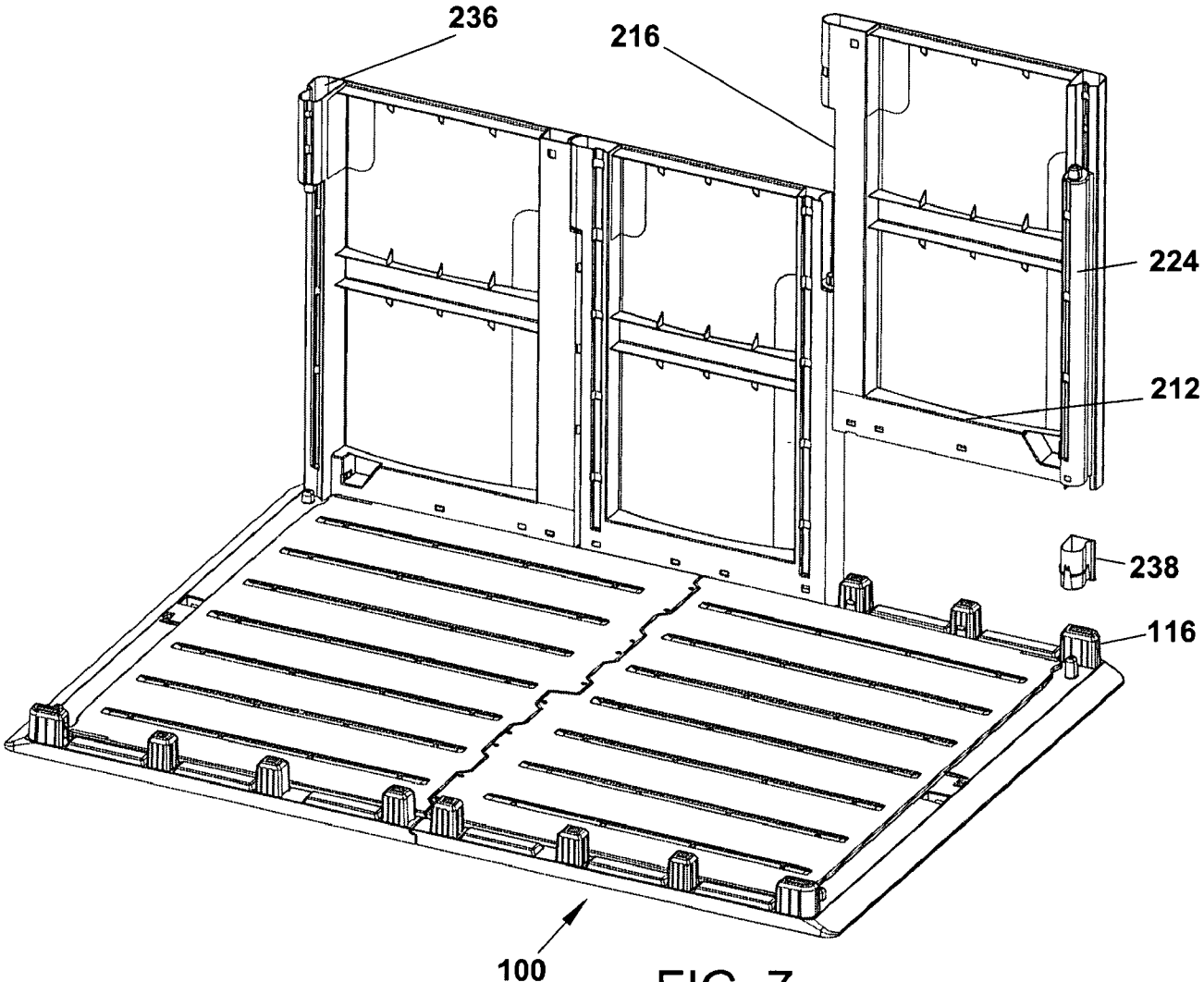
FIG. 7 is a partial perspective view further illustrating assembly of the left side wall panels.

Referring to FIGS. 6-7 a first structural side wall panel is shown. The first structural wall panel 202 constitutes one of a plurality of like-configured panels in the system used to construct the left and right side wall assemblies 200. The first structural wall panels 202 are each configured having a first longitudinal end 208 including an integrally formed attachment means illustrated as a plurality of sockets 210. A second longitudinal end 212 also including an integrally formed attachment means also illustrated as a plurality of sockets 210. The sockets 210 are generally constructed and arranged to cooperate with either a floor assembly 100 or a roof assembly 400. The first horizontal edge 222 is constructed generally flat extending inwardly to a depending semi-circular conduit 224, the semi-circular conduit 224 extending from the second horizontal end 212 toward the mid-portion of the edge 222. The conduit 224 is arranged to cooperate with a structural wall panel member 302 having a complimentary semi-circular conduit in a perpendicular relationship. To facilitate mechanical connection with structural second wall panel members 302 in a co-planar relationship the panels are provided a second horizontal edge 214 constructed with an attachment means illustrated as a semi-circular conduit 216 extending from about the first longitudinal end 208 past the middle portion of the edge 214. Centrally located within the semi-circular conduit 216 is a generally circular aperture 218 for accepting a dowel 220.

Figure 8:
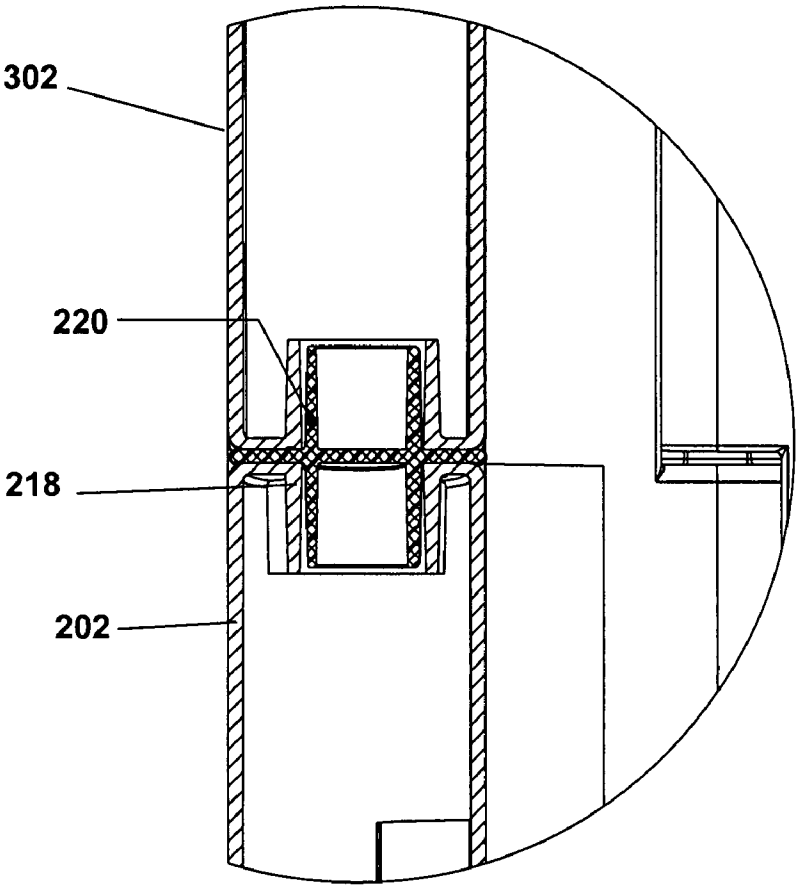
FIG. 8 is a partial cross sectional view illustrating the locking engagement between the dowel and adjacent wall panels.

Continuing with regard to FIGS. 6-8, a third structural side wall panel is shown. The third structural wall panel 203 constitutes one of a plurality of like-configured panels in the system used to construct the left and right side wall assemblies 200. The third structural wall panels 203 are each configured having a first longitudinal end 209 including an integrally formed attachment means illustrated as a plurality of sockets 210. A second longitudinal end 213 also including an integrally formed attachment means also illustrated as a plurality of sockets 210. The sockets 210 are generally constructed and arranged to cooperate with either a floor assembly 100 or a roof assembly 400. To facilitate mechanical connection with structural second wall panel members 302 in a co-planar relationship the panels are provided a first horizontal edge 215 constructed with an attachment means illustrated as a semi-circular conduit 217 extending from about the second longitudinal end 213 toward the middle portion of the edge 215. Centrally located within the semi-circular conduit 217 is a generally circular aperture 218 for accepting a dowel 220. The second horizontal edge 223 is constructed generally flat extending inwardly to a depending semi-circular conduit 224, the semi-circular conduit 224 extending from the first horizontal end 209 toward the mid-portion of the edge 223. The conduit 224 is arranged to cooperate with a structural wall panel member 302 having a complimentary semi-circular conduit in a perpendicular relationship.

Continuing with regard to FIGS. 6-8, the outer surface 228 (FIG. 2) of the panels 202 and 203 are constructed generally smooth having a plurality of inwardly bowed surfaces 230 for added strength and aesthetic appearance. The inside of the panels 232 are constructed with a plurality of ribs 204 extending from the first edge 222, 223 across the panel 202, 203 to the second edge 214, 215 respectively. Each of the ribs 204 being provided with a plurality of gussets 206 to further strengthen the panels. The ribs 204 and gussets 206 increase the structural integrity of the enclosure 10 by preventing the panels 202, 203 from bowing or bending inwardly or outwardly, and thus, adversely affecting the appearance or operation of the enclosure 10. The reinforced ribs also provide support for optional shelves (not shown). The construction of the ribs 204 allow shelving to extend across the span of the shed thereby dividing the load between two walls and eliminating the cantilever effect of attaching a shelf to a single wall surface.

Assembly of the left side wall 200 of the shed is completed by attaching the first wall panel 202, second wall panel 302, and third wall panel 203 to the interconnected floor-panels 102 by sliding the first longitudinal ends 208, 308, 209 respectively over a plurality of the locking posts 116. Thereafter, each corresponding panel being slid into place in an adjacent relationship to the prior panel. The sockets 210 in each end of the panels 202, 302, 203 correspond in shape and size to that of the posts 116. Spring tabs 126 (FIG. 3) integrally formed into the posts 116 align with apertures 234 in the sockets 210 to engage the side wall panels 202, 302 and 203. The result is a positive mechanical connection between the wall-panels 200 and the floor assembly 100. The first wall panel 202 being assembled to the floor assembly 100 with the first longitudinal end 208 downward. The second panel 302 is thereafter assembled adjacent to the first with its first longitudinal end 308 downward (FIG. 7). The third wall panel 203 is assembled adjacent to the second panel with its first longitudinal end 209 downward. Secured to the first longitudinal end 209 of the conduit 224 of the third assembled wall panel 203 is a hinge pin connector 238 constructed and arranged to cooperate with a floor assembly hinge pin 128 (FIG. 3) and the rear wall assembly 300.

It will be appreciated that the purpose of the semi-circular conduits 216, 224 are to align two panels in a co-planar or perpendicular relationship and to facilitate their mechanical connection via the dowel 220. The semi-circular conduits 216, 224 are brought into an overlapping relationship wherein a dowel pin 220 enters the corresponding aperture 218 in each conduit (FIG. 6). The result is a mechanically secure connection between the two panels (FIG. 8). The overlapping edges between the panels as described above provides a secure connection and offers several advantages. First, the design allows the panels to be connected without the need for I-beam connectors. Second, the design creates a positive lock that prevents separation of the panels. Third, the design maintains alignment of the panels in the same plane and prevents bowing or bending of either panel relative to one another. The resultant wall created by the combination of the interlocking wall-panels benefits from high structural integrity and reliable operation.

Figure 9:
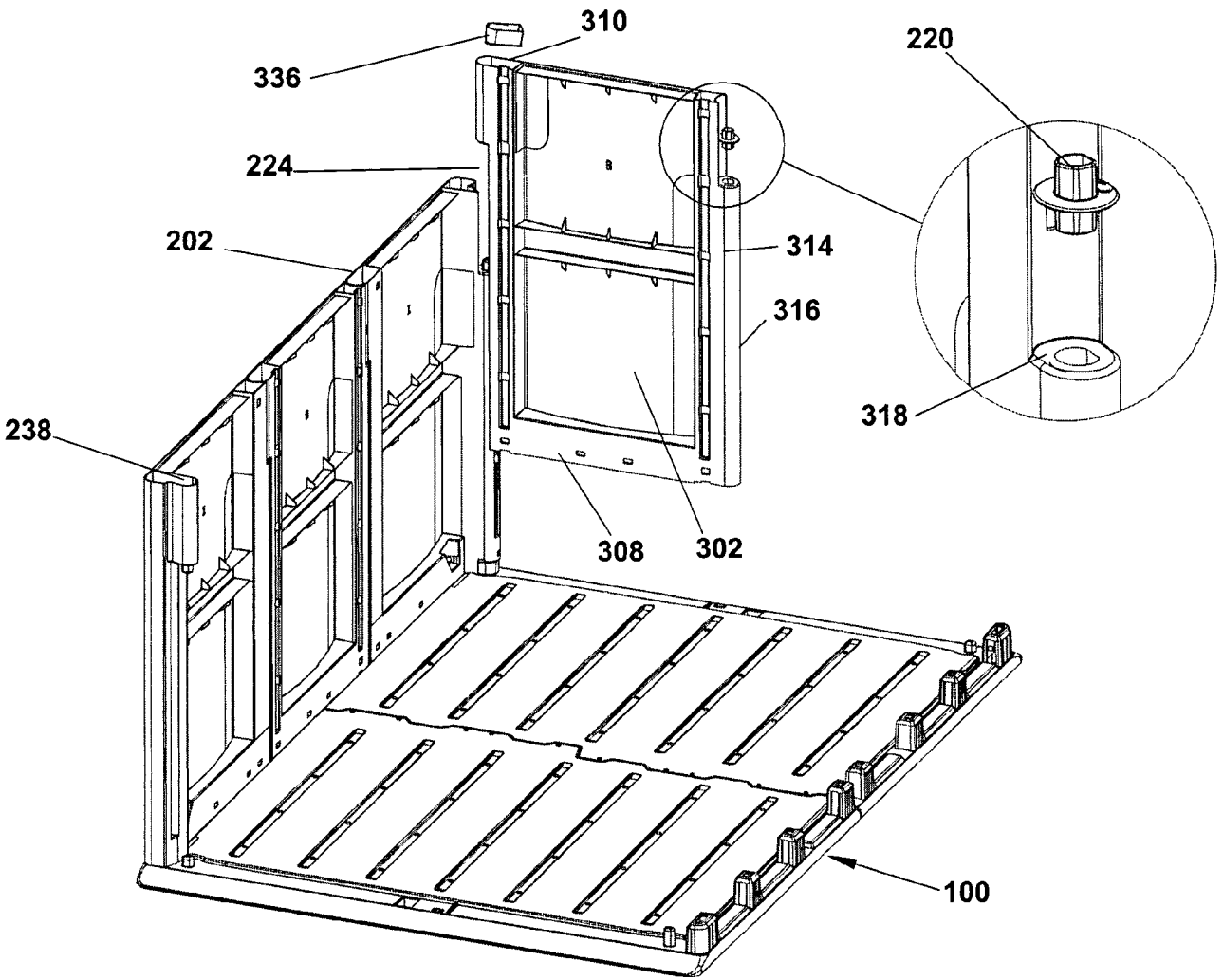
FIG. 9 is a partial perspective view illustrating assembly of the rear wall panels.
Figure 10:
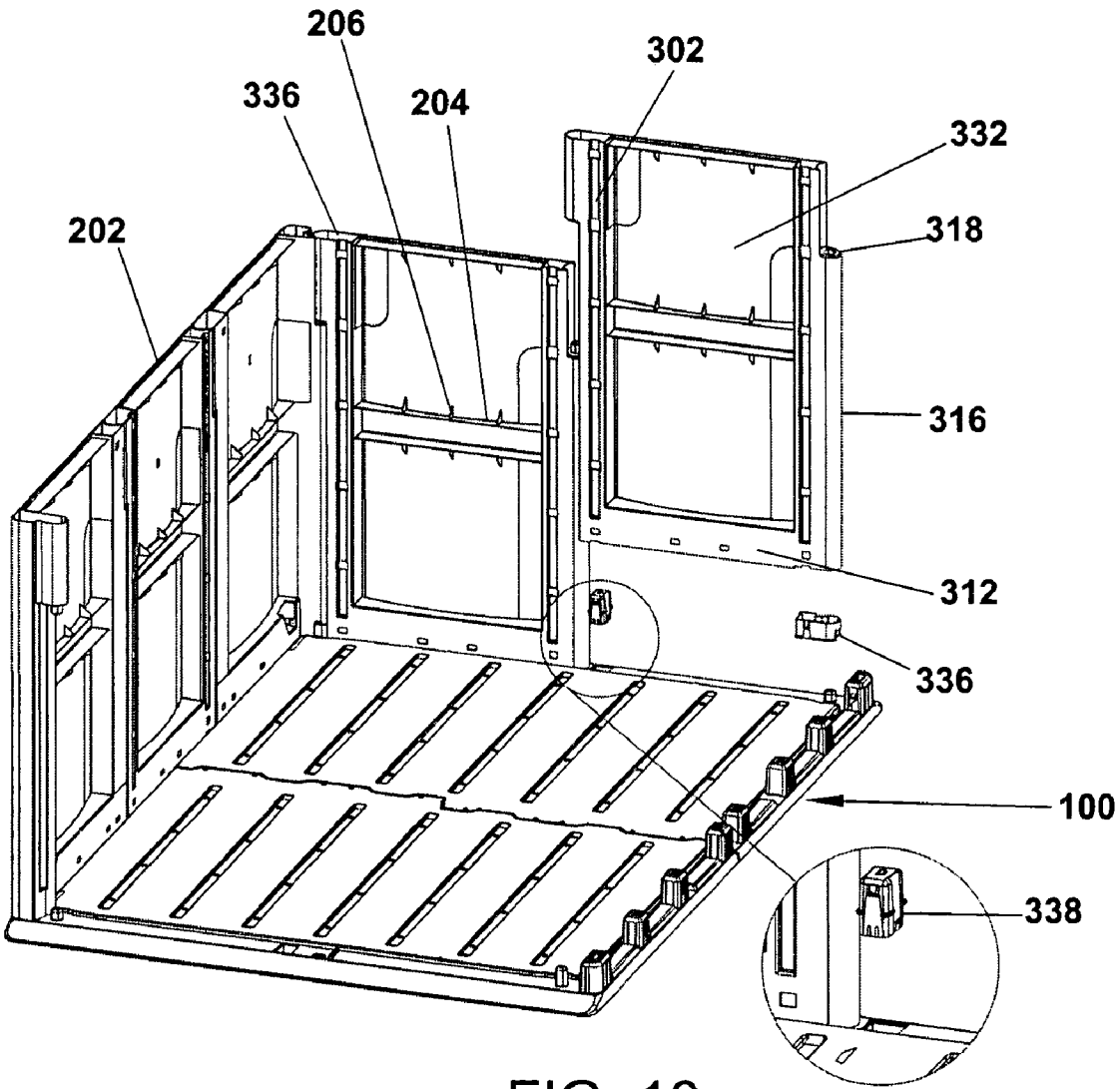
FIG. 10 is a partial perspective view further illustrating assembly of the rear wall panels.

Referring to FIGS. 9-10, assembly of the structural rear wall is shown. The second wall panel 302 constitutes one of a plurality of like-configured panels in the system used to construct the rear wall assembly 300. The second wall panels 302 are each configured having a first longitudinal end 308 including an integrally formed attachment means illustrated as a plurality of sockets 210. A second longitudinal end 312 includes an integrally formed attachment means also illustrated as a plurality of sockets 210. The sockets are generally constructed and arranged to cooperate with either a floor assembly 100 or a roof assembly 400. To facilitate mechanical connection with first, second, or third wall panel members 202, 302, 203 respectively in a co-planar or perpendicular relationship, the panels are provided a first horizontal edge 314 constructed with a semi-circular conduit 316 extending from about the second longitudinal end 312 toward the middle portion of the edge. Centrally located within the semi-circular conduit 316 is a generally circular aperture 318 for accepting a dowel 220. The second horizontal edge 322 is constructed generally the same as the first horizontal edge 314 with the exception that the semi-circular conduit 324 extends from the first horizontal end 308 past the mid-portion of the panel. The conduits 316, 324 are arranged to cooperate with a other panel members having a complimentary semi-circular conduit in a co-planar or a perpendicular relationship. Hinge cap 336 is constructed and arranged to cooperate with the first longitudinal end of the semi-circular conduit and a floor assembly hinge pin 128.

Continuing with regard to FIGS. 9-10, the outer surface 328 (FIG. 2) of the panels 302 are constructed generally smooth having a plurality of inwardly bowed surfaces 330 (FIG. 2) for added strength and aesthetic appearance. The inside of the panel 332 is constructed with a plurality of ribs 304 extending from the first edge 314 across the panel to the second edge 322. Each of the ribs 304 being provided with a plurality of gussets 306 to further strengthen the panel 302. The ribs 304 and gussets 306 increase the structural integrity of the enclosure 10 by preventing the panels 302 from bowing or bending, inwardly or outwardly and thus, adversely affecting the appearance or operation of the enclosure 10.

The panels 302 are attached to the interconnected floor panels 102 and the installed left side panels 202, 203 by sliding the first longitudinal end 308 of a second wall panel downward over a dowel 220 aligning the semi-circular conduits. The second assembled rear panel 302 being adjacent in relation to the first and slid downward engaging the inserted post 338 and the hinge pin in the floor assembly via a hinge cap 336 inserted into the semi-circular conduit and engaging the first assembled rear panel via the dowel 220. Spring tabs 126 integrally formed into the inserted post 338 and hinge caps 336 align with apertures 234 in the second wall panels 302 for engagement. The result is a positive mechanical connection between the left wall assembly 200, rear wall assembly 300 and the floor assembly 100.

Figure 11:
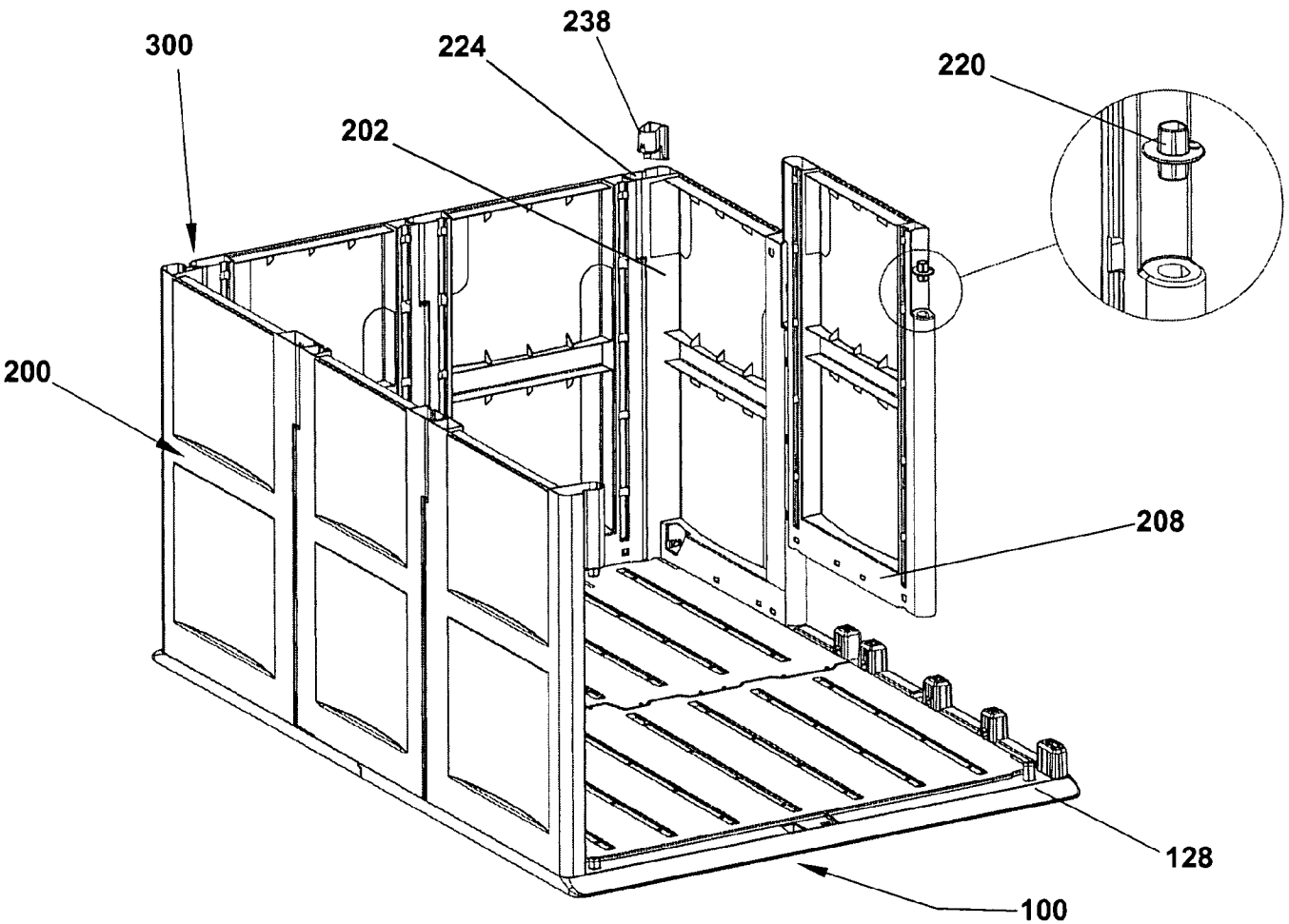
FIG. 11 is a partial perspective view illustrating assembly of the right side wall panels.
Figure 12:
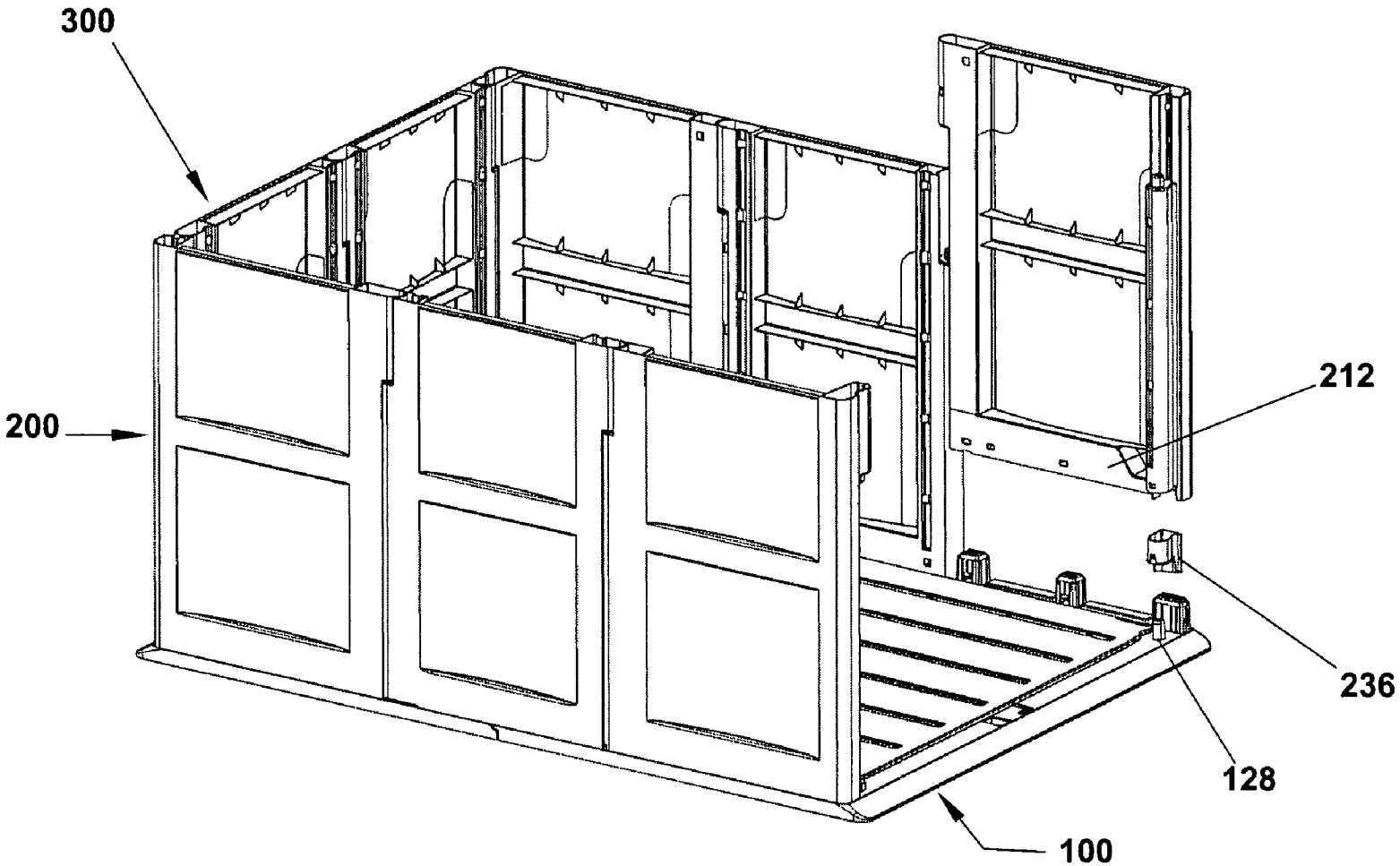
FIG. 12 is a partial perspective view further illustrating assembly of the right side wall panels.

Referring to FIGS. 11-12 the right side wall panels are attached to the interconnected floor-panels 102 and the assembled rear wall assembly 300 by sliding the first longitudinal end 208 of a first wall panel 202 over a plurality of the locking posts 116. The second wall panel 302 is thereafter assembled adjacent to the first with its first longitudinal end 308 downward (FIG. 7). The third wall panel 203 is assembled adjacent to the second panel with its first longitudinal end 209 downward. Secured to the first longitudinal end 209 of the conduit 224 of the third assembled wall panel 203 is a hinge pin connector 238 constructed and arranged to cooperate with a floor assembly hinge pin 128 (FIG. 12) to allow rotational movement of the door assembly 500. The sockets 210 in the ends of the panels 202, 203 and 302 correspond in shape and size to that of the posts 116, and spring tabs 126 (FIG. 3) integrally formed into the posts 116 align with apertures 234 in the sockets 210 to engage the side wall panel 202, 203 or 302. The result is a positive mechanical connection between the wall panels 200 and the floor assembly 100.

Figure 13:
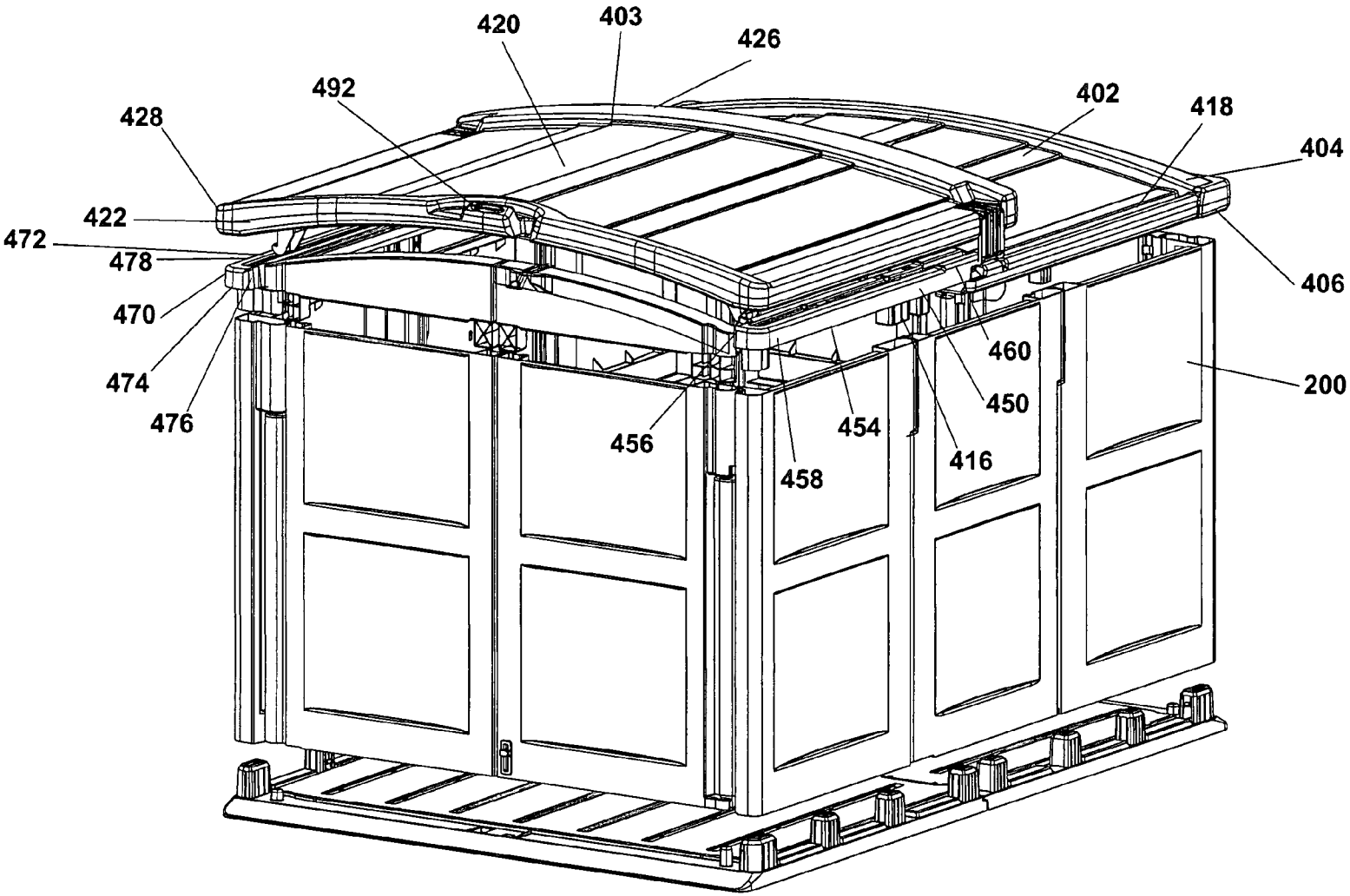
FIG. 13 is a perspective partially exploded view of the roof panels utilized in the instant invention.
Figure 14:
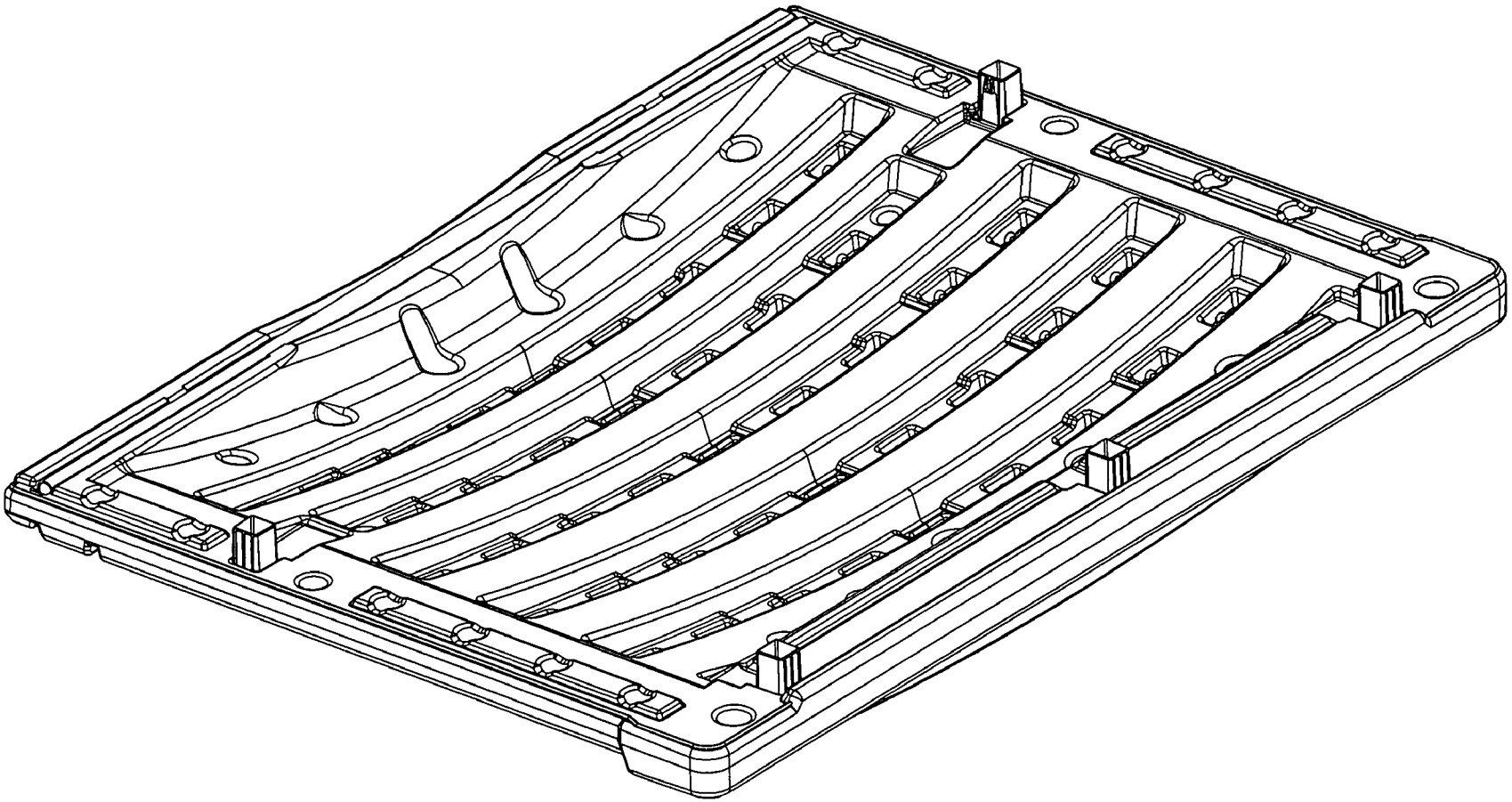
FIG. 14 is a perspective view of the bottom surface of the telescoping roof panel utilized in the instant invention.
Figure 15:
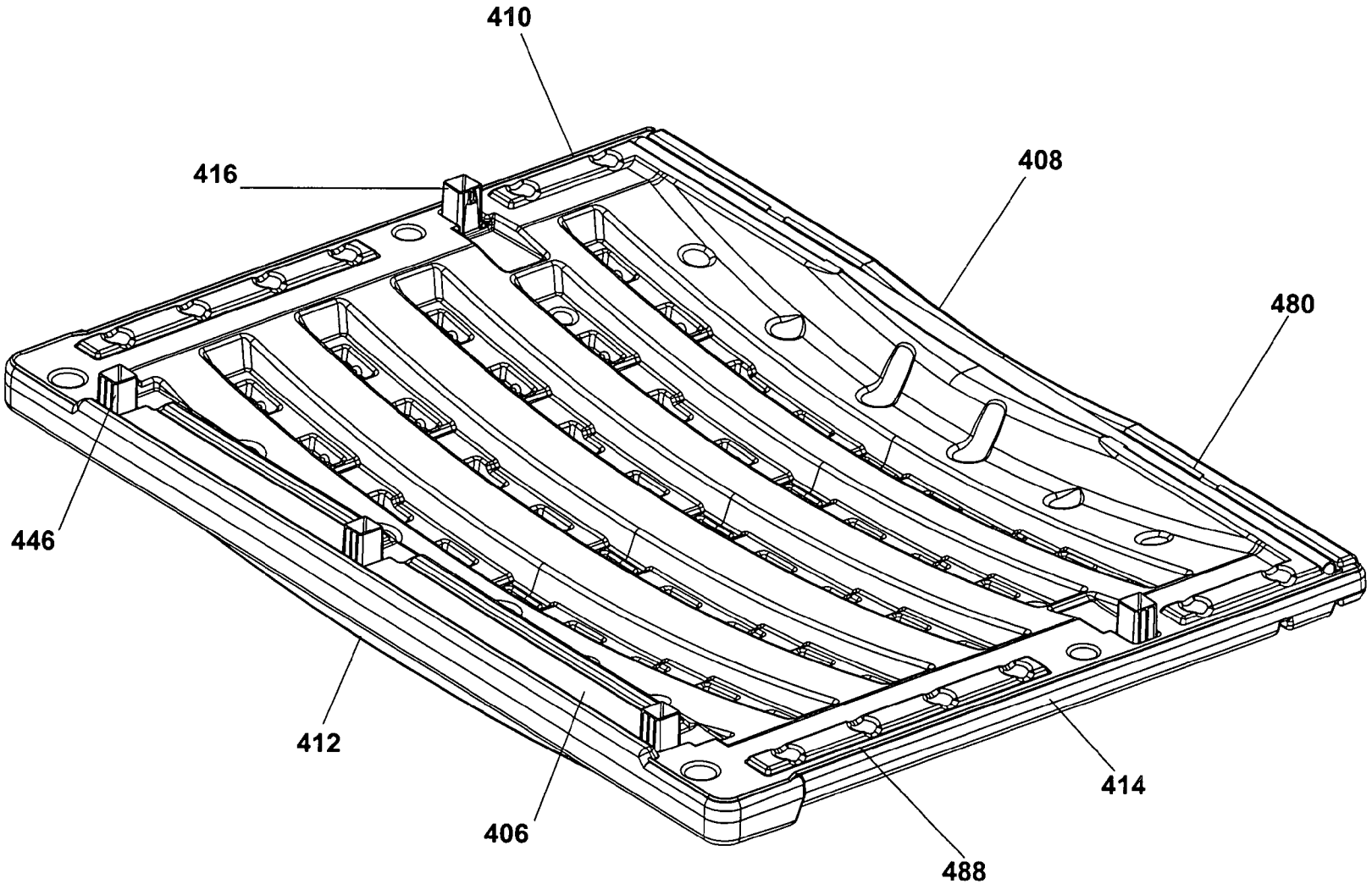
FIG. 15 is a perspective view of the bottom surface of the fixed roof panel utilized in the instant invention.
Figure 16:
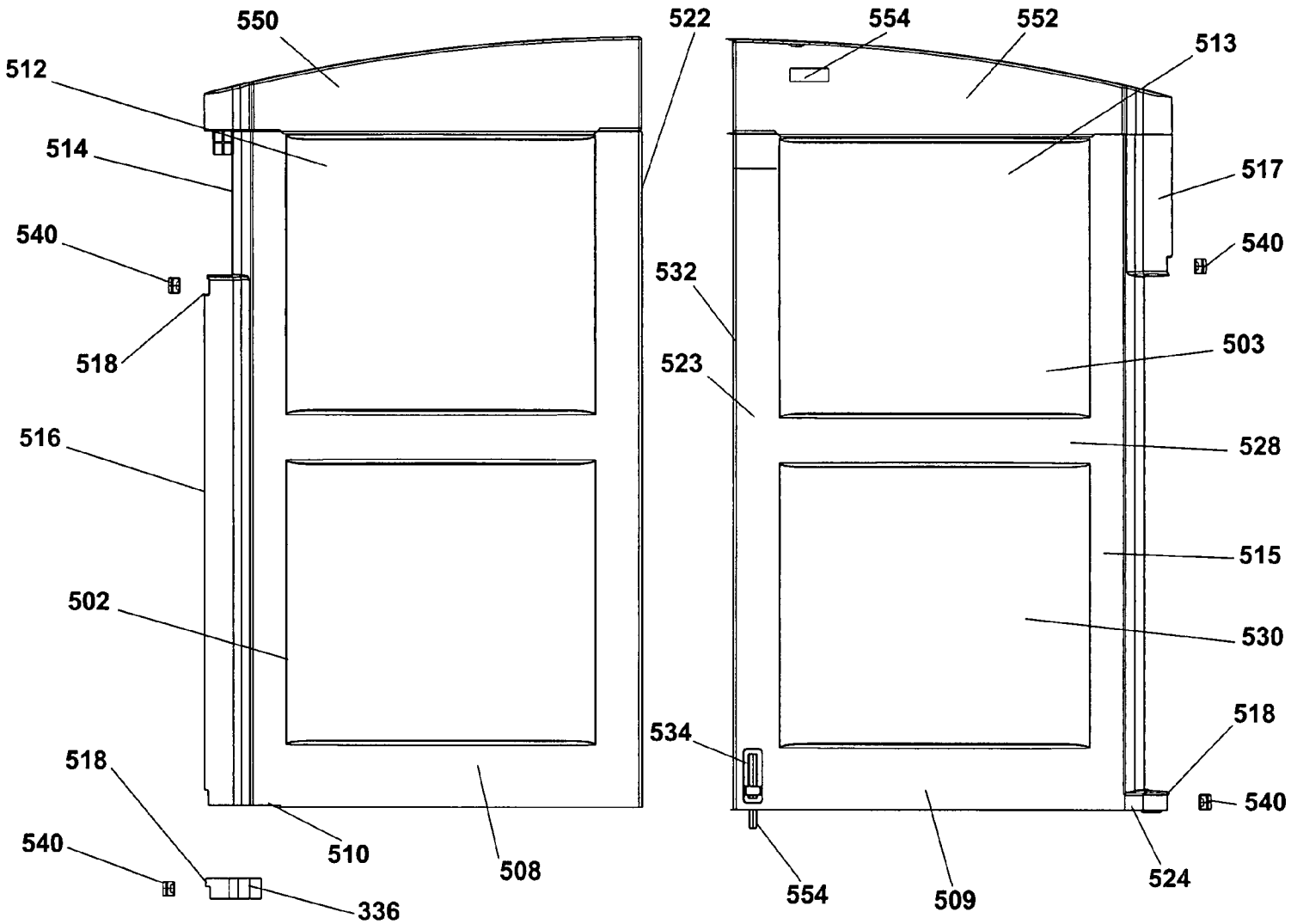
FIG. 16 is a front view illustrating the door assembly utilized in the instant invention.

Referring to FIGS. 13-15 the enclosure 10 includes a fixed roof panel 402 and a sliding roof panel 403. The fixed roof panel includes a top surface 404, bottom surface 406, and four closed edges 408, 410, 412 and 414. The bottom surface of the fixed roof panel is constructed generally smooth and may include a securely attached steel reinforcement tube 480 to add additional structural integrity to the roof assembly. (FIG. 15) Adjacent to the two side closed edges 410, 414 and the rear closed edge 412 are a plurality of locking posts 416 extending outwardly from the bottom surface 406. The locking posts 416 are constructed and arranged to cooperate with sockets 210 located at the second longitudinal end of the structural wall panels 202, 203 and 302. The fixed roof panel 402 is placed over the assembled left, right, and rear walls and lowered into place. The locking posts 416 are lined up with the corresponding sockets 210 in the wall panels 202, 203, and 302. The fixed roof panel 402 is secured in place by pulling downward on the panel until the spring tabs 446 integrally formed into the locking posts 416 engage corresponding apertures 234 formed in the sockets 210. The result is a positive mechanical connection between the wall panels 202 and 302 and the fixed roof panel 402.

The fixed roof panel 402 includes an upper track groove 418 adjacent to each of the two side closed edges 410, 414 and extending along the top surface 404. The upper track groove 418 extends inwardly into the fixed roof panel and is constructed generally having a V-shaped cross section, and is arranged to cooperate with the tracks 430 which extend outwardly from the bottom surface 422 of the telescoping roof panel 403. The fixed roof panel also includes a outer track groove 488 adjacent to each of the two side closed edges 410, 414 extending along the bottom surface 406. The outer track groove 488 extends inwardly into the fixed roof panel 402 and is constructed having a generally U-shaped cross section.

Continuing with regard to FIGS. 13-15, the roof assembly 400 also includes a right wall cap 450 and a left wall cap 470. The right wall cap includes a top surface 452, a bottom surface 454, an inner closed edge 456, and an outer closed edge 458. The lower surface 454 is constructed with a plurality of outwardly extending locking posts 416 which are arranged to cooperate with sockets 210 located at each longitudinal end of the structural wall panels 202, 302, and 203. Along the lower surface 454 and adjacent to the inner closed edge 456 is an inner track groove 482 having a generally U-shaped cross section. The top surface 452 is constructed generally smooth having an upper track groove 460 with a generally V-shaped cross section extending along a longitudinal centerline.

The right wall cap 450 is placed over the assembled right wall and lowered into place. The locking posts 416 are lined up with the corresponding sockets 210 in the wall panels 202, 203, and 302. The right wall cap 450 is secured in place by pulling downward on the cap until the spring tabs 446 integrally formed into the locking posts 416 engage corresponding apertures 234 formed in the sockets 210. The result is a positive mechanical connection between the wall panels 202, 203 and 302 and the wall cap 450.

The left wall cap 470 includes a top surface 472, a bottom surface 474, an inner closed edge 476, and an outer closed edge 478. The bottom surface 474 is constructed and arranged with a plurality of outwardly extending locking posts 416 which cooperate with sockets 210 located at the second longitudinal end of the structural wall panels 202, 203 and 302. Along the bottom surface 474 and adjacent to the inner closed edge 476 is a generally U-shaped inner track groove 482. The top surface 472 is constructed generally smooth having an upper track groove 460 with a generally V-shaped cross section extending along a longitudinal centerline.

The left wall cap 470 is placed over the assembled left wall and lowered into place. The locking posts 416 are lined up with the corresponding sockets 210 in the wall panels 202 and 302. The left wall cap 470 is secured in place by pulling downward on the cap until the spring tabs 446 integrally formed into the locking posts 416 engage corresponding apertures 234 formed in the sockets 210. The result is a positive mechanical connection between the wall panels 202 and 302 and the left wall cap 470.

Continuing with regard to FIGS. 13-15, the telescoping roof panel 403 includes a top surface 420, bottom surface 422, and four closed edges 424, 426, 428 and 430. The top surface is constructed generally smooth and includes a pair of integrally formed sockets 484 which are constructed and arranged to slidingly cooperate with outer track guides 490. The outer track guides 490 are generally C-shaped and constructed and arranged to be secured to the telescoping roof panel 403 and to slidingly cooperate with the outer track groove 488 in the fixed roof panel 402. The upper surface also includes an integrally formed handle 492. The bottom surface includes a plurality of strengthening ribs 482. The strengthening ribs add structural rigidity and load capacity to the roof assembly 400. The bottom surface 422 also includes a pair of integrally formed sockets 484 which are constructed and arranged to cooperate with inner track guides 486. The inner track guides 486 are constructed and arranged to slidingly cooperate with their respective inner track grooves 482 in wall caps 450, 470. Adjacent to each of the two side closed edges 424, 428 and depending downwardly from the bottom surface 422 are tracks 430. The tracks 430 have a generally V-shaped cross section to cooperate with the upper track grooves 418 of the fixed roof panel 402 and the wall caps 450 and 470.

The telescoping roof panel 403 is placed over the assembled fixed roof panel 402, and the assembled first and second wall caps 450, 470 and lowered into place aligning the tracks 430 with their respective upper track grooves 418. The inner track guides 486 are secured in place by pushing upward on each of the inner track guides until the spring tabs 446 integrally formed into the inner track guides 486 engage corresponding apertures 234 formed in the sockets 484. The result is a positive mechanical connection between the inner track guides 486 and the telescoping roof panel 403. The outer track guides are secured in place by pushing downward on the outer track guide until the spring tabs 446 engage corresponding apertures 234 formed in the sockets 484. The result is a positive mechanical connection between the inner track guides 486 and the telescoping roof panel 403. The cooperative sliding engagement between the upper, inner, and outer track guides allow the telescoping roof panel to be easily and reliably retracted and extended to allow easy access to the enclosure contents. The construction of the inner and outer track guides provide anti-lift protection and security to the contents of the enclosure.

Referring to FIGS. 16-19, the enclosure includes a door assembly including a left and a right door panel, a hinge means, a left and a right door header, and a latch assembly. The left door panel 502 and right door panel 503 constitute the panels in the system used to construct the door assembly. The left door panel 502 is configured having a first longitudinal end 508 including at least one integrally formed socket 210. The socket 210 is generally constructed and arranged to cooperate with a hinge cap 336 having a C-shaped annular portion. The second longitudinal end 512 includes a plurality of integrally formed sockets 510. The sockets are generally constructed and arranged to cooperate with the left header 550. The left header 550 is constructed with a plurality of outwardly extending locking posts 416 which are constructed and arranged to cooperate with sockets 210 located at the second longitudinal end 512 of the left door panel 502. To facilitate mechanical connection with other side wall panel members 202 in a pivoting relationship the left side panel is provided with a first horizontal edge 514 constructed with a semi-circular conduit 516 extending from about the first longitudinal end 508 past the middle portion of the edge. The hinge cap 336, and the semi-circular conduit 516 each containing at least one hinge means illustrated as a C-shaped annular portion 518 having an open side 520 constructed and arranged to accept a hinge pin 128, or a dowel pin 220 and to cooperate with a hinge clip 540 to close the annular cavity 518 and allow pivoting movement of the left door panel 502. The second horizontal edge 522 is constructed generally flat.

The right door panel 503 is configured having a first longitudinal end 509 which includes an integrally formed C-shaped annular hinge portion 524. The second longitudinal end 513 includes a plurality of integrally formed sockets 510. The sockets are generally constructed and arranged to cooperate with the right header 552. The right header 552 is constructed with a plurality of outwardly extending locking posts 416 which are constructed and arranged to cooperate with sockets 210 located at the second longitudinal end 513 of the left door panel 503. To facilitate mechanical connection with other side wall panel members 202 in a pivoting relationship the right door panel is provided with a first horizontal edge 515 constructed with a semi-circular conduit 517 extending from about the second longitudinal end 513 toward the middle portion of the edge. The integrally formed hinge portion 524, and the semi-circular conduit 517 each containing at least one hinge means illustrated as a C-shaped annular portion 518 having an open side 520 constructed and arranged to accept a hinge pin 128, or a dowel pin 220 and to cooperate with a hinge clip 540 to close the annular cavity 518 and allow pivoting movement of the right door panel 503. The second horizontal edge 523 is constructed generally flat with the exception of a optional ledge 532 extending the full length of the panel. The optional ledge 532 may be attached by any suitable fastening means well known in the art or may be integrally formed with the panel. The right door panel 503 is also provided with a lower sliding latch mechanism 534.

Continuing with regard to FIGS. 16-19, the outer surface 528 of the panels 502, 503 are constructed generally smooth having a plurality of inwardly bowed surfaces 530 for added strength and aesthetic appearance. The inside surface of the left and right door panels 502 and 503 are constructed with a plurality of ribs 504 extending from the first edge 514 across the panel 502 to the second edge 522. Each of the ribs 504 may be provided with a plurality of gussets (not shown) to further strengthen the panel 502. The ribs 504 increase the structural integrity of the enclosure 10 by preventing the panels 502 from bowing or bending, inwardly or outwardly and thus, adversely affecting the appearance or operation of the enclosure 10.

Figure 17:
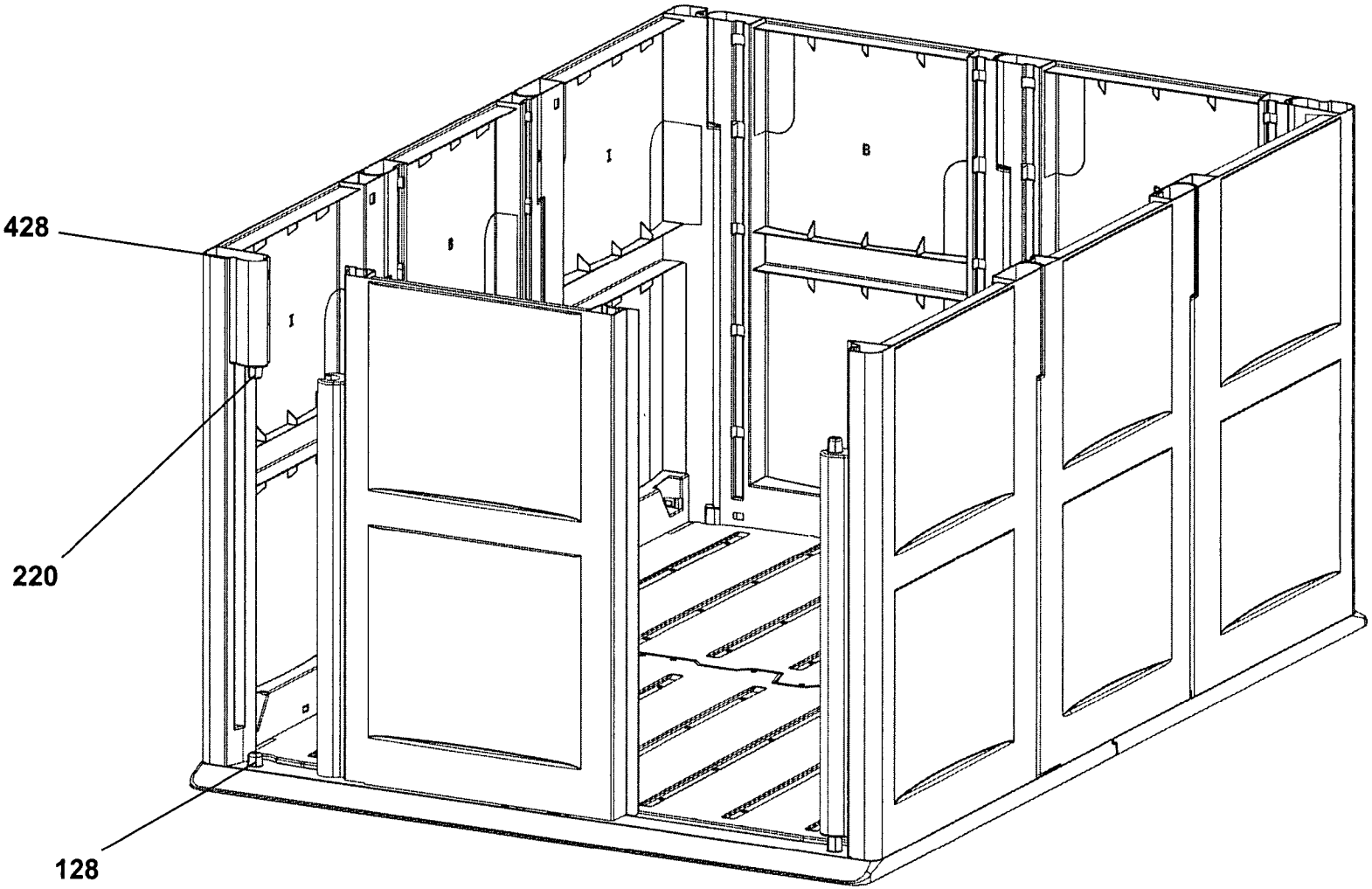
FIG. 17 is a perspective view illustrating the installation of one of the doors.
Figure 18:
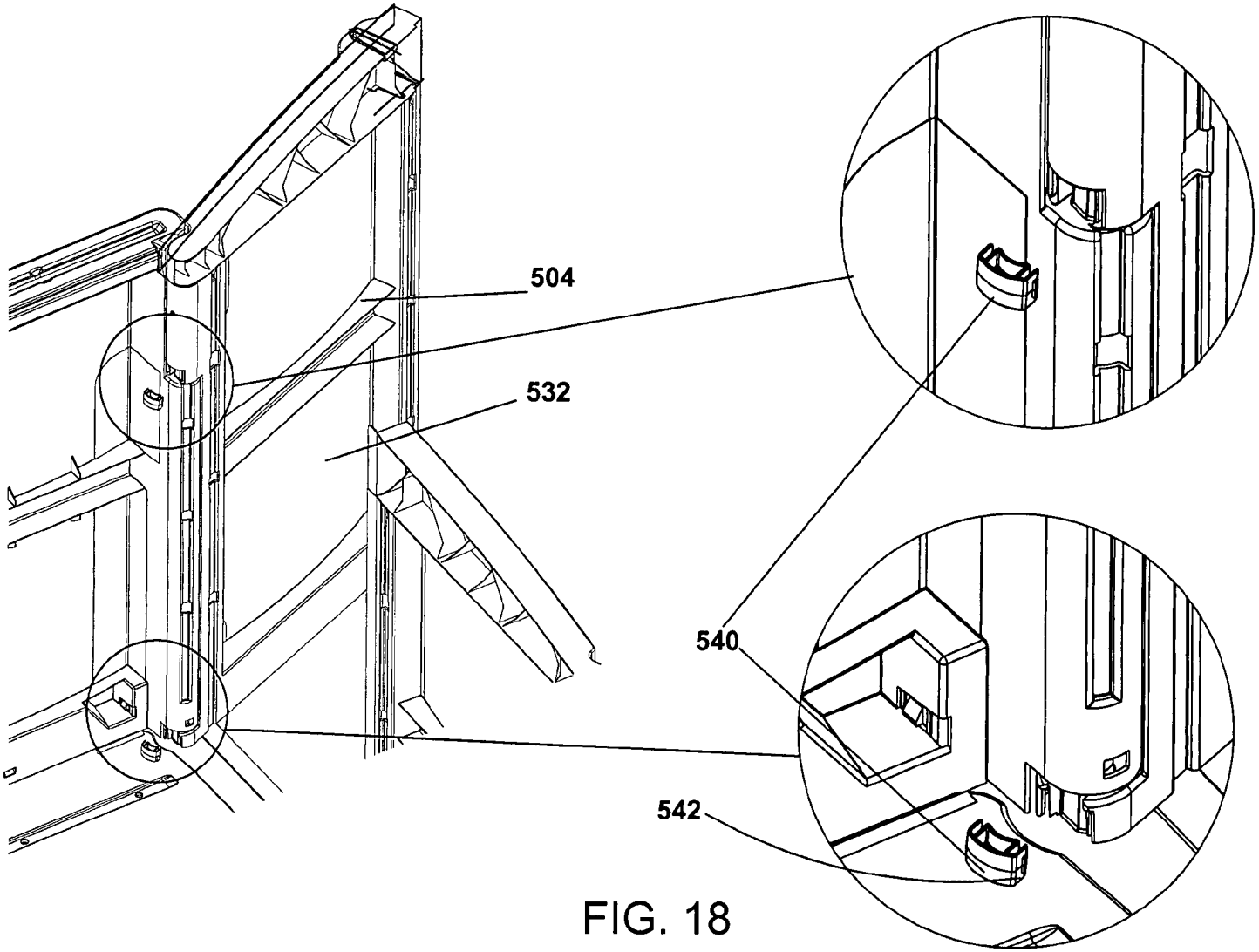
FIG. 18 is a partial perspective view of the enclosure with enlarged partial views illustrating assembly of the door hinges utilized in the instant invention.
Figure 19:
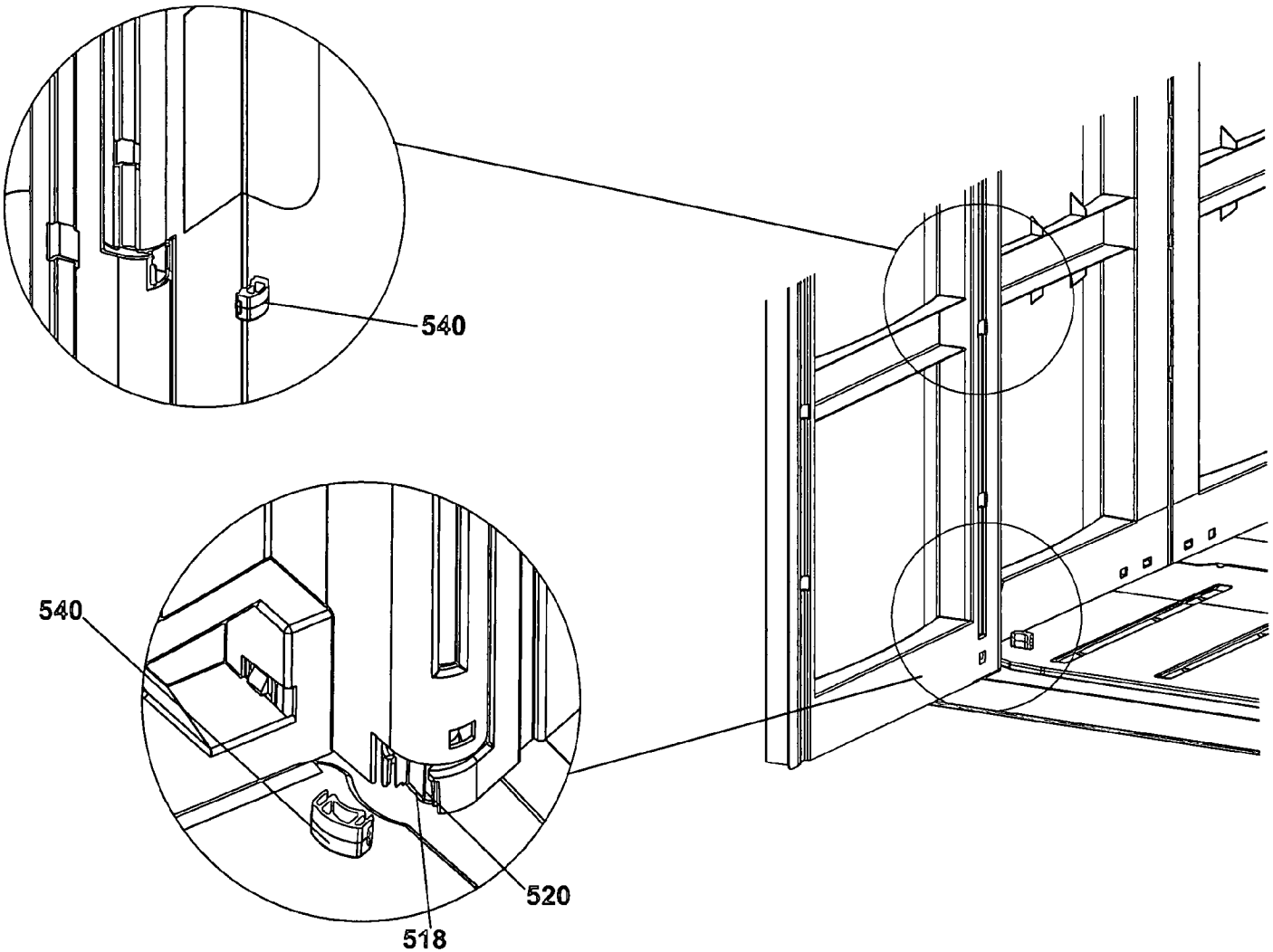
FIG. 19 is a partial perspective view of the enclosure with enlarged partial views illustrating assembly of the door hinges utilized in the instant invention.

Referring to FIG. 17-19, the door panels 502, 503 are attached to the interconnected floor panels 100, and the left and right side wall assemblies 200 by aligning the hinge pins and sliding the panel horizontally into place over the respective pins and engaging the hinge clips 540. The body of the hinge clip 540 is generally concave and rectangular and includes spring tabs 542 located at each end adapted to fit within the respective hinge caps to secure the door panels to the hinge pins and facilitate independent rotational movement of each door. It should be appreciated that this construction allows the doors to be installed or removed without disassembling or partially disassembling other components from the enclosure 10. The construction also provides economic advantage allowing inexpensive hinge components to be easily removed and replaced in the event they become damaged. The right door panel is also provided with removable and replaceable door latching mechanism 534.

Figure 21:
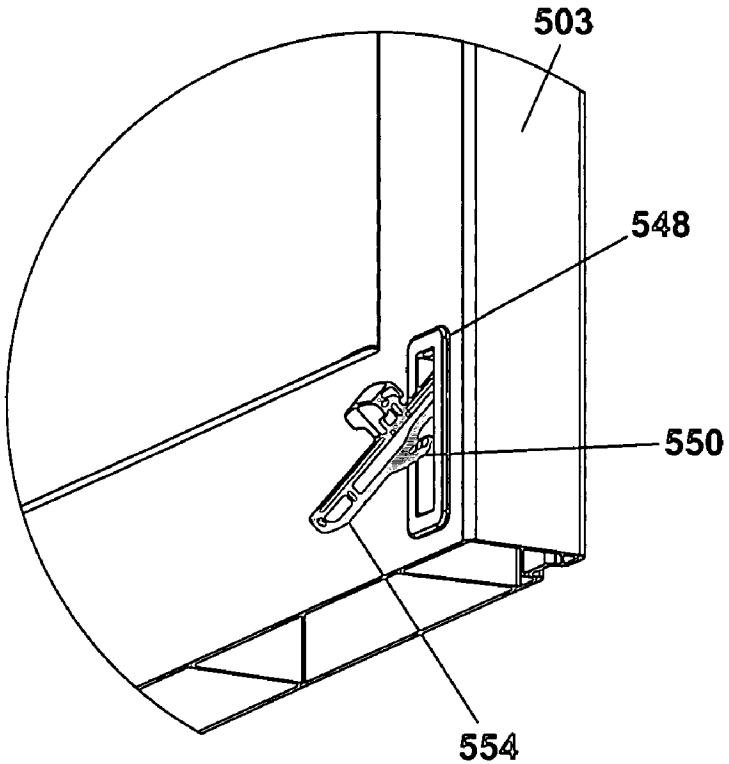
FIG. 21 is a partial view illustrating assembly of one of the door latch pins utilized in the instant invention.
Figure 20:
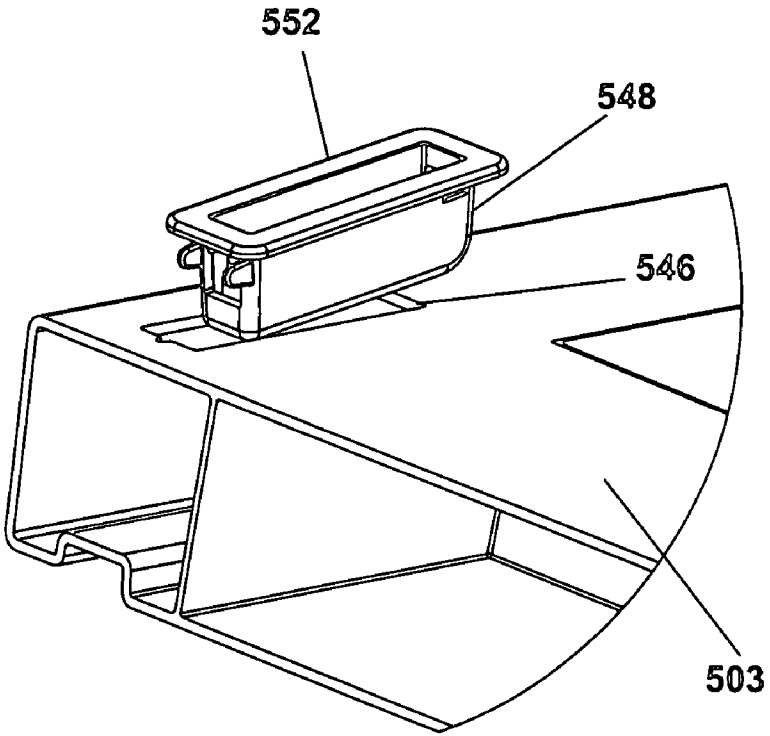
FIG. 20 is a partial view illustrating assembly of one of the door latch housings utilized in the instant invention.

Referring to FIGS. 20-21, installation of the lower door latch is illustrated. The door latch is constructed and arranged to allow simple push-in installation. The latch housings 552 are merely pushed into apertures 546 located adjacent to edge 523 in the door panel 503 until the spring clips 548 engage the panel 503. Thereafter the one end of the door latch pin 554 is inserted through the housing 552 and downwardly until spring clip 550 is snapped into place. In this manner the door latches can be installed and removed as need without the need for tools or screw type fasteners. By sliding the latch pin 554 to extend it outwardly to engage the floor assembly 100 the contents contained within the enclosure 10 are secured.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A panel system for constructing a low profile enclosure comprising:

a floor assembly for enclosing the bottom of said low profile enclosure;

a pair of side wall assemblies for enclosing the left side and right side of said low profile enclosure;

a rear wall assembly for enclosing the back of said low profile enclosure;

a pivoting door assembly for enclosing and providing ingress into and egress from said low profile enclosure;

a telescoping roof assembly for enclosing the top of said low profile enclosure system and for providing ingress into and egress from said low profile enclosure, said telescoping roof assembly including a fixed roof panel, a telescoping roof panel, a left wall cap, and a right wall cap, at least one of said left wall cap and said right wall cap including a top surface, a bottom surface, an inner closed edge, and an outer closed edge, said bottom surface being constructed with a plurality of outwardly extending locking posts which cooperate with integrally formed sockets located at a second longitudinal end of said wall panels, said bottom surface including an inner track groove, said inner track groove having a generally U-shaped cross section, said inner track groove located adjacent to and extending along said inner closed edge, said top surface including an upper track groove having a generally V-shaped cross section and extending along said top surface, said inner track groove and said upper track groove cooperate with said telescoping roof panel permitting said telescoping roof panel to telescope inwardly and outwardly with respect to said fixed roof panel, said telescoping roof panel including a top surface, a bottom surface, a front closed edge, a rear closed edge, a left closed edge, and a right closed edge, said bottom surface including a plurality of strengthening ribs constructed and arranged to provide structural rigidity and load capacity to said telescoping roof panel;

wherein said pivoting door assembly and said telescoping roof assembly cooperate to allow walk-in access to the contents of said low profile enclosure, and wherein said low profile enclosure can be shipped in a disassembled state and assembled on a desired site.

2. The low profile enclosure panel system of claim 1 wherein said left wall assembly and said right wall assembly include two like-constructed first wall panel members and two like-constructed second wall panel members and two like-constructed third wall panel members, wherein said left wall assembly includes one of said first wall panels and one of second wall panels and one of said third wall panels and said right side wall assembly includes one of said first wall panels and one of second wall panels and one of said third wall panels.

3. The low profile enclosure panel system of claim 2 wherein said first wall panel member includes a first longitudinal end having an attachment means constructed and arranged to cooperate with a floor assembly, a second longitudinal end having an attachment means constructed and arranged to cooperate with a roof assembly, a first horizontal edge constructed generally flat extending inwardly to a depending attachment means constructed and arranged to cooperate with a second wall panel member or a door panel member in a perpendicular relationship, and a second horizontal edge having an attachment means constructed and arranged to cooperate with a second wall panel member in a co-planar relationship.

4. The low profile enclosure panel system of claim 3 wherein said first longitudinal end attachment means includes at least one integrally formed socket and said second longitudinal end attachment means includes at least one integrally formed socket.

5. The low profile enclosure panel system of claim 3 wherein said first horizontal edge attachment means includes a semi-circular conduit extending from about the second longitudinal end toward the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

6. The low profile enclosure panel system of claim 3 wherein said second horizontal edge attachment means includes a semi-circular conduit extending from about the first longitudinal end past the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

7. The low profile enclosure panel system of claim 2 wherein said second wall panel member includes a first longitudinal end having an attachment means constructed and arranged to cooperate with a floor assembly, a second longitudinal end having an attachment means constructed and arranged to cooperate with a roof assembly, a first horizontal edge having an attachment means constructed and arranged to cooperate with a first wall panel member in a co-planar relationship, and a second horizontal edge having an attachment means constructed and arranged to cooperate with a third wall panel member in a co-planar relationship.

8. The low profile enclosure panel system of claim 7 wherein said first longitudinal end attachment means includes at least one integrally formed socket and said second longitudinal end attachment means includes at least one integrally formed socket.

9. The low profile enclosure panel system of claim 7 wherein said first horizontal edge attachment means includes a semi-circular conduit extending from about the second longitudinal end toward the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

10. The low profile enclosure panel system of claim 7 wherein said second horizontal edge attachment means includes a semi-circular conduit extending from about the first longitudinal end past the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

11. The low profile enclosure panel system of claim 2 wherein said third wall panel member includes a first longitudinal end having an attachment means constructed and arranged to cooperate with a floor assembly, a second longitudinal end having an attachment means constructed and arranged to cooperate with a roof assembly, a first horizontal edge having an attachment means constructed and arranged to cooperate with a second wall panel member in a co-planar relationship, and a second horizontal edge constructed generally flat extending inwardly to a depending attachment means constructed and arranged to cooperate with a second wall panel member or a door panel member in a perpendicular relationship.

12. The low profile enclosure panel system of claim 11 wherein said first longitudinal end attachment means includes at least one integrally formed socket and said second longitudinal end attachment means includes at least one integrally formed socket.

13. The low profile enclosure panel system of claim 11 wherein said first horizontal edge attachment means includes a semi-circular conduit extending from about the second longitudinal end toward the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

14. The low profile enclosure panel system of claim 11 wherein said second horizontal edge attachment means includes a semi-circular conduit extending from about the first longitudinal end past the middle portion of said edge, said conduit having a generally circular aperture for accepting a dowel centrally located within said middle portion end of said semi-circular conduit;

wherein said semicircular conduit is brought into an overlapping relationship with a corresponding semi-circular conduit and a dowel pin enters said circular apertures in each conduit resulting in a mechanically secure connection between the two said panels.

15. The low profile enclosure panel system of claim 1 wherein said rear wall assembly includes a pair of like-constructed second wall panel members.

16. The low profile enclosure panel system of claim 1 wherein said telescoping roof assembly includes a fixed roof panel, a telescoping roof panel, a left wall cap, and a right wall cap.

17. The low profile enclosure panel system of claim 16 wherein said fixed roof panel is constructed and arranged to accept at least one steel roof support for adding increased weight capacity and stability to said roof assembly of said enclosure.

18. The low profile enclosure panel system of claim 16 wherein said telescoping roof panel includes a top surface, a bottom surface, a front closed edge, a rear closed edge, a left closed edge, and a right closed edge, wherein said top surface includes a pair of integrally formed sockets, one of said top surface sockets located adjacent to said left closed edge and said rear closed edge and one of said top surface sockets located adjacent to said right closed edge and said rear closed edge, said top surface sockets constructed and arranged to cooperate with C-shaped outer track guides having integrally formed locking posts, wherein said bottom surface includes a pair of integrally formed sockets, wherein one of said bottom surface sockets is located adjacent to said left closed edge and said front closed edge and one of said bottom surface sockets is located adjacent to said right closed edge and said front closed edge, said bottom surface sockets constructed and arranged to cooperate with J-shaped inner track guides having integrally formed locking posts, wherein said bottom surface includes a pair of generally parallel outwardly extending V-shaped guide rails, said guide rails integrally formed on said bottom surface, wherein one of said guide rails is located adjacent to said left closed edge and one of said guide rails is located adjacent to said left closed edge;

whereby said V-shaped guide rails are constructed and arranged to slidingly cooperate with said V-shaped track guides and said C-shaped outer track guides are constructed and arranged to slidingly cooperate with U-shaped outer track grooves and said J-shaped inner track guides are constructed and arranged to slidingly cooperate with said U-shaped inner track grooves located within said left and said right wall caps to allow said telescoping roof panel to telescope inwardly and outwardly with respect to said fixed roof panel.

19. The low profile enclosure panel system of claim 1 wherein said door assembly includes a left door panel including a left door header and a right door panel including a right door header, wherein said left door panel and said right door panel enclose and provide ingress into and egress out of said low profile enclosure.

20. The low profile enclosure panel system of claim 19 wherein said left door includes a first longitudinal end including a plurality of integrally formed sockets, said sockets constructed and arranged to cooperate with a hinge means, a second longitudinal end including a plurality of integrally formed sockets, a first horizontal edge having a semi-circular conduit extending from about said first longitudinal end past the middle portion of said edge, said conduit having an integrally formed hinge means, a second horizontal edge being generally flat, wherein said left door header is constructed with a plurality of outwardly extending locking posts which are constructed and arranged to cooperate with said sockets located at said second longitudinal end of said left door panel.

21. The low profile enclosure panel system of claim 20 wherein said hinge means includes a C-shaped annular portion for accepting a hinge pin, said C-shaped annular portion constructed and arranged to cooperate with a hinge clip to close said annular portion and allow pivoting movement of said door panels, wherein said C-shaped hinge means allows said left door panel to be assembled to said enclosure without partial disassembly of other portions of said enclosure.

22. The low profile enclosure panel system of claim 19 wherein said right door includes a first longitudinal end including a plurality of integrally formed sockets, said sockets constructed and arranged to cooperate with a hinge means, a second longitudinal end including a plurality of integrally formed sockets, a first horizontal edge having a semi-circular conduit extending from about said second longitudinal end toward the middle portion of said edge, said conduit having an integrally formed hinge means, a second horizontal edge being generally flat, wherein said right door header is constructed with a plurality of outwardly extending locking posts which are constructed and arranged to cooperate with said sockets located at said second longitudinal end of said right door panel.

23. The low profile enclosure panel system of claim 22 wherein said hinge means includes a C-shaped annular portion for accepting a hinge pin, said C-shaped annular portion constructed and arranged to cooperate with a hinge clip to close said annular portion and allow pivoting movement of said door panels, wherein said C-shaped hinge means allows said right door panel to be assembled to said enclosure without partial disassembly of other portions of said enclosure.

24. The low profile enclosure panel system of claim 1 wherein said plurality of strengthening ribs are integrally formed to said bottom surface of said telescoping roof panel.

25. A panel system for constructing a low profile enclosure comprising:

a floor assembly for enclosing the bottom of said low profile enclosure, said floor assembly including a pair of like-configured floor panel members for constructing said floor assembly, each of said floor members having a top surface, said top surface having a means of attaching said floor assembly to said side wall assemblies, said rear wall assembly, and said door assembly, a bottom surface constructed and arranged to provide rigidity and stability to said floor assembly, a locking edge constructed and arranged with a means to connect like-configured locking edges of said like-configured floor panels into said floor assembly, said means to connect like-configured locking edges includes a series of spaced apart fingers and recesses along the locking edge of each said bottom panel, each of said fingers being provided with at least one countersunk aperture for receiving a fastener, said fingers and recesses constructed and arranged so that said fingers overlap and mateably engage said recesses and said fasteners secure said floor panel members together in an inter-fitting engagement with their respective top surfaces in a co-planar arrangement, a ramp edge for easy loading and unloading of said low profile enclosure, and two closed edges for maintaining a weather resistant enclosure;

a pair of side wall assemblies for enclosing the left side and right side of said low profile enclosure;

a rear wall assembly for enclosing the back of said low profile enclosure;

a pivoting door assembly for enclosing and providing ingress into and egress from said low profile enclosure;

a telescoping roof assembly for enclosing the top of said low profile enclosure system and for providing ingress into and egress from said low profile enclosure;

wherein said pivoting door assembly and said telescoping roof assembly cooperate to allow walk-in access to the contents of said low profile enclosure, and wherein said low profile enclosure can be shipped in a disassembled state and assembled on a desired site.

26. The low profile enclosure panel system of claim 25 wherein said floor panel members include a plurality of spaced apart tubes extending through each said floor panel under said top surface and above said bottom surface and extending between said locking edge and said ramp edge, said tubes being sized to accept floor joists thereby adding increased weight capacity and stability to said enclosure.

27. A panel system for constructing a low profile enclosure comprising:

a floor assembly for enclosing the bottom of said low profile enclosure;

a pair of side wall assemblies for enclosing the left side and right side of said low profile enclosure;

a rear wall assembly for enclosing the back of said low profile enclosure;

a pivoting door assembly for enclosing and providing ingress into and egress from said low profile enclosure;

a telescoping roof assembly for enclosing the top of said low profile enclosure system and for providing ingress into and egress from said low profile enclosure, said telescoping roof assembly including a fixed roof panel, a telescoping roof panel, a left wall cap, and a right wall cap, at least one of said left wall cap and said right wall cap including a top surface, a bottom surface, an inner closed edge, and an outer closed edge, wherein said bottom surface is constructed with a plurality of outwardly extending locking posts which are constructed and arranged to cooperate with integrally formed sockets located at the second longitudinal end of said wall panels, said bottom surface including an inner track groove having a generally U-shaped cross section, said inner track groove located adjacent to and extending along said inner closed edge, said top surface including an upper track groove having a generally V-shaped cross section and extending along the longitudinal centerline of said left wall cap, wherein said inner track groove and said upper track groove are constructed and arranged to cooperate with said telescoping roof panel to allow said telescoping roof panel to telescope inwardly and outwardly with respect to said fixed roof panel;

wherein said pivoting door assembly and said telescoping roof assembly cooperate to allow walk-in access to the contents of said low profile enclosure, and wherein said low profile enclosure can be shipped in a disassembled state and assembled on a desired site.

* * * * *